US007607661B2

(12) United States Patent
Akiyama et al.

(10) Patent No.: US 7,607,661 B2
(45) Date of Patent: Oct. 27, 2009

(54) CONTROL DEVICE, CONVEYANCE CONTROL DEVICE, CONVEYANCE SYSTEM AND IMAGE FORMING SYSTEM

(75) Inventors: Shigeki Akiyama, Nagoya (JP); Mitsuhiro Nozaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 256 days.

(21) Appl. No.: 11/188,727

(22) Filed: Jul. 26, 2005

(65) Prior Publication Data

US 2006/0022401 A1 Feb. 2, 2006

(30) Foreign Application Priority Data

Jul. 27, 2004 (JP) ..... 2004-219052

(51) Int. Cl.
*B65H 7/02* (2006.01)

(52) U.S. Cl. ..... 271/265.01

(58) Field of Classification Search ..... 700/229, 700/213

See application file for complete search history.

(56) References Cited

U.S. PATENT DOCUMENTS 5,112,038 A * 5/1992 Dunaway ..... 271/10.03
6,027,112 A * 2/2000 Guenther et al. ..... 271/194
6,240,335 B1 * 5/2001 Wehrung et al. ..... 700/230
6,718,227 B1 * 4/2004 Schemmel et al. ..... 700/213
6,941,190 B2 * 9/2005 Gsell et al. ..... 700/229
2003/0184002 A1 10/2003 Akiyama et al.

FOREIGN PATENT DOCUMENTS

JP 3-121628 5/1991
JP 2003291433 12/1991
JP 4-302302 10/1992
JP 6-6994 A 1/1994
JP 6-266402 9/1994

OTHER PUBLICATIONS

JP Office Action dtd Aug. 12, 2008, JP Appln. 2004-219052.

* cited by examiner

*Primary Examiner*—Patrick H Mackey
*Assistant Examiner*—Howard Sanders
(74) *Attorney, Agent, or Firm*—Banner & Witcoff, Ltd.

(57) ABSTRACT

The control device includes a target setter that sets the target travel distance of the driving object in every predetermined period when the driving object is moved, and an operation amount determiner that determines whether or not the operation amount calculated by the operation amount calculator is equal to or more than a predetermined upper limit. The target setter sets the target travel distance according to a first rule when the operation amount is determined by the operation amount determiner to be less than the upper limit. When the operation amount is determined to be equal to or more than the upper limit by the operation amount determiner, the target setter sets according to a second rule.

9 Claims, 26 Drawing Sheets

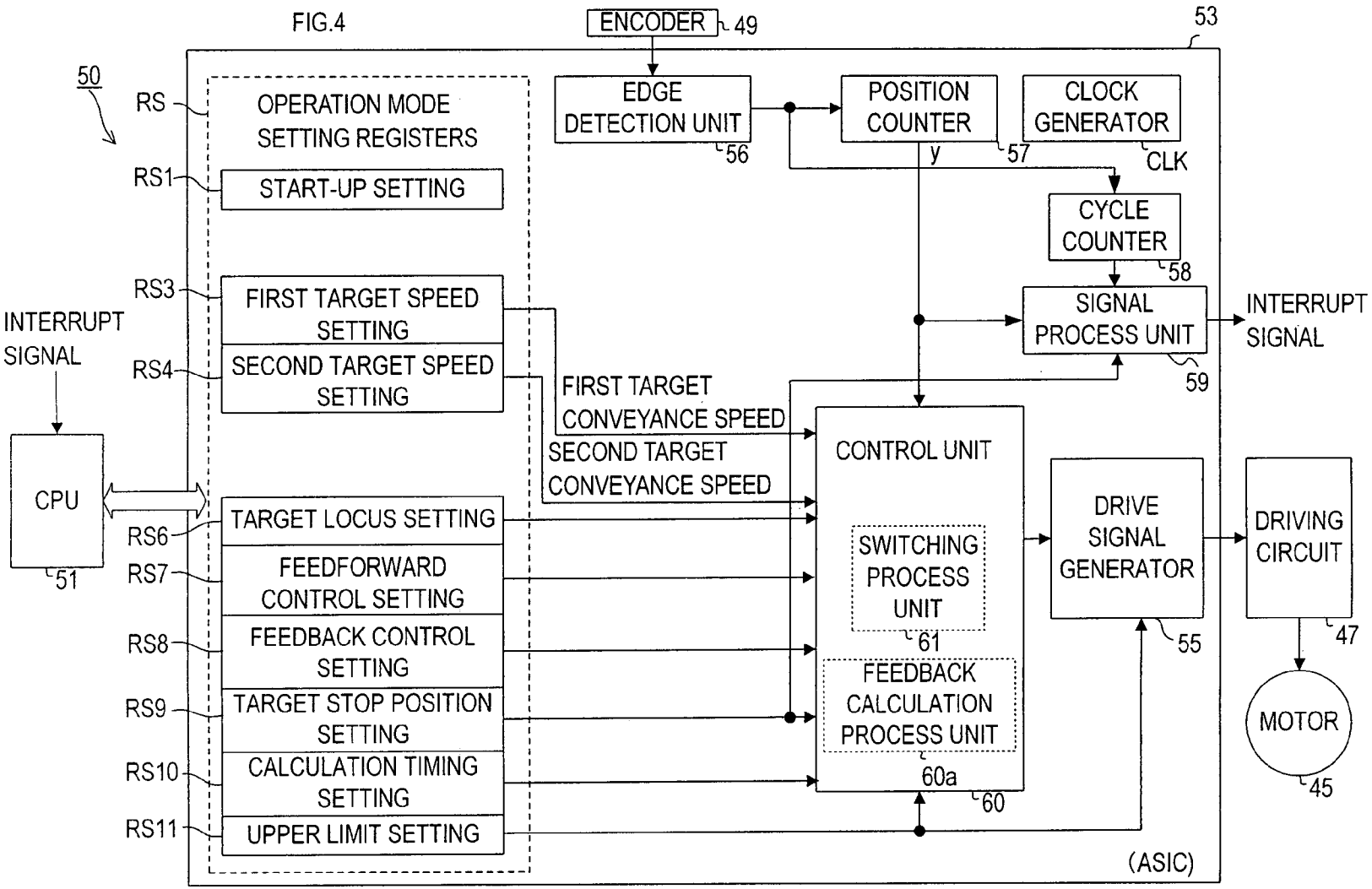
FIG.4
50
53
ENCODER
49
EDGE DETECTION UNIT
56
POSITION COUNTER
57
y
CLOCK GENERATOR
CLK
CYCLE COUNTER
58
SIGNAL PROCESS UNIT
59
INTERRUPT SIGNAL
DRIVING CIRCUIT
47
MOTOR
45
DRIVE SIGNAL GENERATOR
55
(ASIC)
CONTROL UNIT
SWITCHING PROCESS UNIT
61
FEEDBACK CALCULATION PROCESS UNIT
60a
60
FIRST TARGET CONVEYANCE SPEED
SECOND TARGET CONVEYANCE SPEED
OPERATION MODE SETTING REGISTERS
START-UP SETTING
FIRST TARGET SPEED SETTING
SECOND TARGET SPEED SETTING
TARGET LOCUS SETTING
FEEDFORWARD CONTROL SETTING
FEEDBACK CONTROL SETTING
TARGET STOP POSITION SETTING
CALCULATION TIMING SETTING
UPPER LIMIT SETTING
RS
RS1
RS3
RS4
RS6
RS7
RS8
RS9
RS10
RS11
INTERRUPT SIGNAL
CPU
51

CONTROL DEVICE, CONVEYANCE CONTROL DEVICE, CONVEYANCE SYSTEM AND IMAGE FORMING SYSTEM

CROSS-REFERENCE TO RELATED APPLICATIONS

This application claims the benefit of Japanese Patent Application No. 2004-219052 filed on Jul. 27, 2004 in the Japanese Patent Office, the disclosure of which is incorporated herein by reference.

BACKGROUND

The present invention relates to: a control device that controls a driving device to move an object for a predetermined distance; a conveyance control device that controls a conveyance device to convey an object along a conveyance path; a conveyance system with the conveyance control device; and an image forming system that forms an image at a conveyance destination on an object conveyed by the conveyance system.

Conventionally, an inkjet image forming system is known wherein an image is formed on an image forming medium, such as paper. In this type of image forming system, ink is jetted out from a recording head that serves as an image forming device, and an image is formed on an image forming medium based upon image data. Consequently, the above-described system is provided with a mechanism (conveyance device) for conveying an image forming medium, e.g. paper, to an image formation point wherein image formation is conducted by the image forming device, and a conveyance control device.

A conventional conveyance device that conveys an object, such as paper, is provided with one pair of conveyance rollers that are disposed along a conveyance path and respectively rotate on rotational axis perpendicular to a conveyance direction of an object to be conveyed. In this type of conveyance device, an object is held by the above-described pair of conveyance rollers that are facing to each other, driving force (frictional force) in a rotational direction of the conveyance rollers is applied thereon, and conveyed in the rotational direction by the conveyance rollers being rotated while the object is held therebetween.

As for a control device, a control device having two functions: feedback control function and feedforward control function, is conventionally known.

SUMMARY

The control device according to one aspect of the present invention is connected to a driving device that is operated according to a control signal inputted therein and moves a driving object by applying a driving force corresponding to the operation amount of the driving device. By controlling the driving device, the control device moves the driving object for a predetermined distance. The control device includes: a detector that detects travel distance of the driving object; a target setter that sets the target travel distance of the driving object in every predetermined period when the driving object is moved; an operation amount calculator that calculates an operation amount of the driving device that is necessary to attain the target travel distance set by the target setter based on a detection result of the detector; a controller for the driving device to move the driving object for a predetermined distance by sequentially inputting a control signal into the driving device corresponding to the operation amount calculated by the operation amount calculator; and an operation amount determiner that determines whether or not the operation amount calculated by the operation amount calculator is equal to or more than a predetermined upper limit. The target setter sets the target travel distance according to a first rule when the operation amount is determined by the operation amount determiner to be less than the upper limit. When the operation amount is determined to be equal to or more than the upper limit by the operation amount determiner, the target setter sets the travel distance according to a second rule.

The control device according to one aspect of the present invention is capable of conducting the most suitable control even when the operation amount becomes equal to or more than the upper limit,

BRIEF DESCRIPTION OF THE DRAWINGS

The invention will now be described below, by way of example, with reference to the accompanying drawings.

FIG. 4 is a block diagram to show the structure of the conveyance control unit of the embodiment;

DETAILED DESCRIPTION OF THE PREFERRED EMBODIMENT

Figure 1:
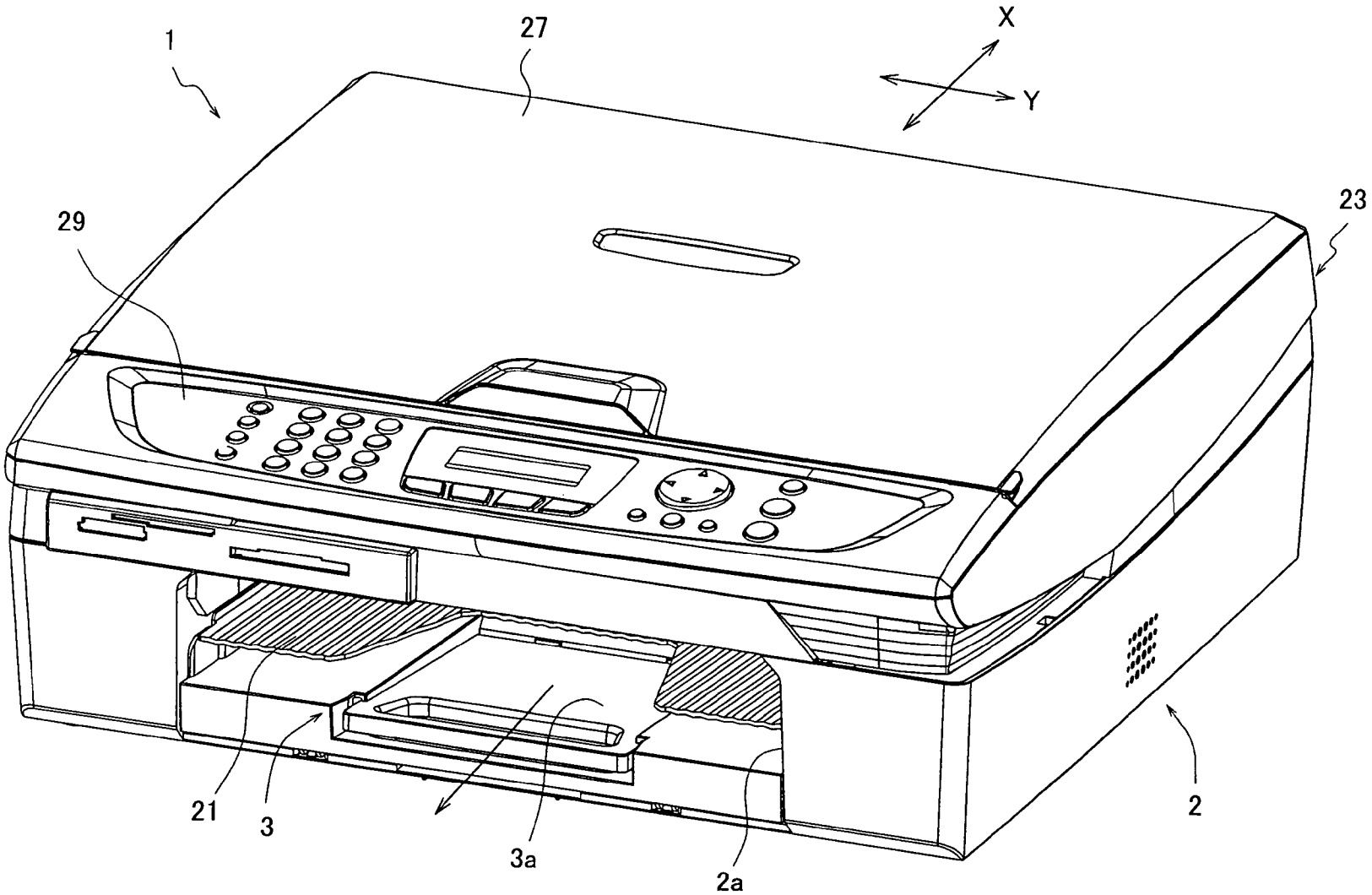
FIG. 1 is a perspective view to show the structure of a Multi Function Device to which the image formation system of the present invention is applied.
Figure 2:
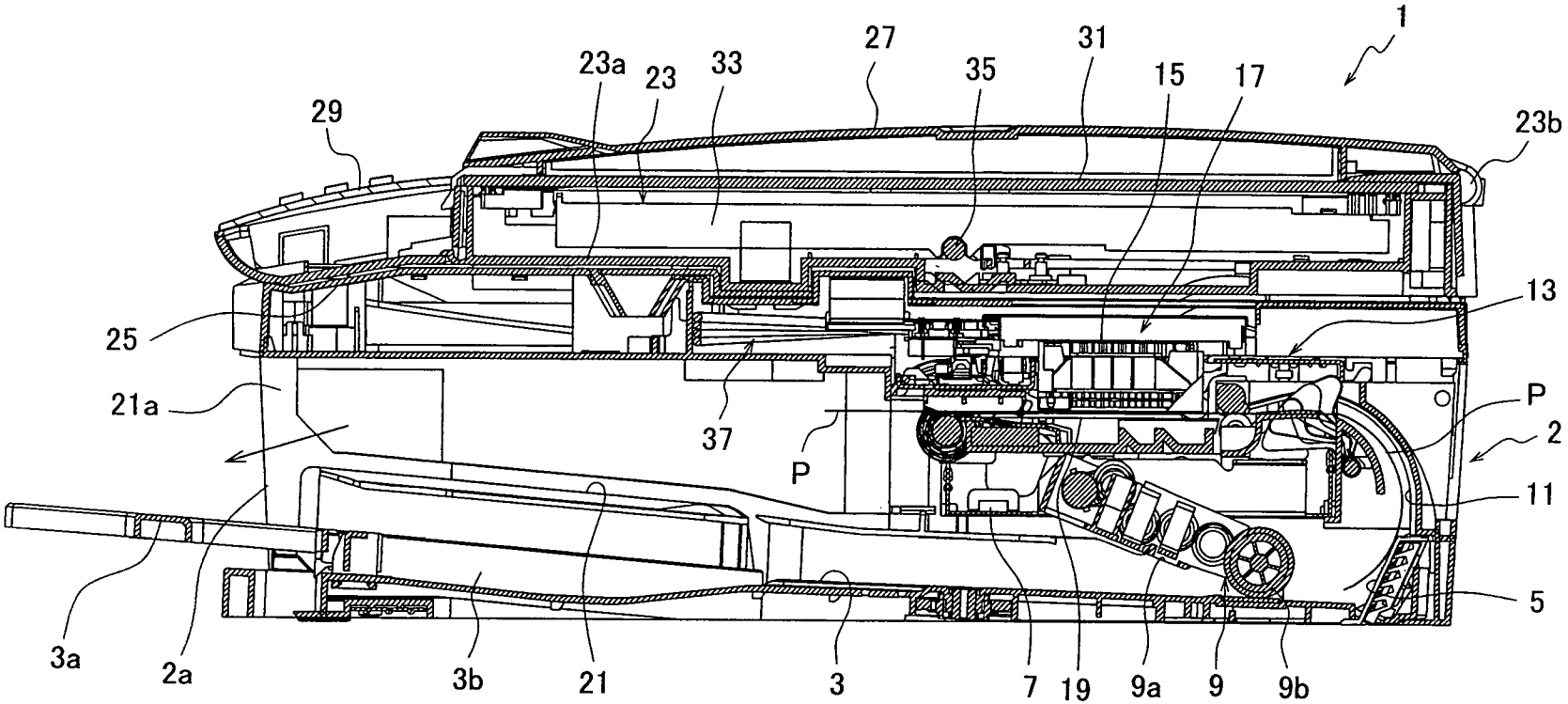
FIG. 2 is a sectional side view to show the MFD of the embodiment.

Referring to FIGS. 1 and 2, the MFD (Multi Function Device) 1 of the present embodiment serves as a printer, copier, scanner and facsimile, and comprises, on a bottom of a housing 2 made of synthetic resin, a feed cassette 3, which can be inserted into the housing 2 from an opening 2*a* provided on a front side of the housing 2.

The feed cassette 3 is constituted to be able to store a plurality of paper P, for example, in A4 or legal sizes. The narrow side of each paper P is placed in parallel to a direction (corresponding to a main scanning direction and Y-axis) orthogonal to a paper conveyance direction (corresponding to a sub-scanning direction and the X-axis).

On the front end of the feed cassette 3, a support member 3*a*, movable in the X-axis direction, is attached to support the rear end portion of paper P having a long length (such as in legal-size). FIG. 2 shows an example wherein the support member 3*a* is exteriorly extended from the housing 2. However, the support member 3*a* can be stored into a storage space 3*b* so as to not interrupt the feeding, in which case paper P can fit into the feed cassette 3 (such as for A4 size paper).

On the rear side of the feed cassette 3, a bank 5 is provided to separate the sheets of paper P. On the bottom plate of a box-shaped metal mainframe 7 of the MFD 1, the rear end of a feed arm 9*a* of a feed unit 9 is attached so as to be rotatable in the vertical direction. Paper P stored in the feed cassette 3 in layers are fed separately in a sheet-by-sheet manner by a feed roller 9*b* provided at the bottom end of the feed arm 9*a* and the bank 5. A sheet of paper P, separated as above, is conveyed to an image forming unit 13 disposed above (at a higher position) the feed cassette 3 via a U-turn path 11 constituting a conveyance path in a U shape.

The image forming unit 13 comprises a carriage 17 which carries an inkjet recording head 15 thereto, and can reciprocate in the main scanning direction. The carriage 17 is controlled by CPU 51 that is to be described later, and moves the recording head 15 in the main scanning direction. The recording head 15 ejects ink while scanning and forms an image on stationary paper P, which is placed under the recording head 16. During image formation, paper P is supported from below by a platen 19 constituting a conveyance path. That is, the recording head 15 is located over the platen 19. Image formation on paper P by the recording head 15 is conducted over the platen 19.

Paper P is discharged to a discharge unit 21 after image formation is conducted thereon by the image forming unit 13. The discharge unit 21 is formed on the upper side of the feed cassette 3. A discharge outlet communicating with the discharge unit 21 has an opening that forms one portion of the opening 2*a* on the front surface of the housing 2.

On the housing 2, an image reading device 23 is disposed to be used for reading an original image. A bottom wall 23*a* of this image reading device 23 is disposed overlapping an upper cover 25 almost without any interspace therebetween. The image reading device 23 is turnable around one end of the housing 2 via a pivot (not shown) so as to be opened and closed. The rear end of a cover 27 covering the upper surface of the image reading device 23 is attached to the rear end of the image reading device 23 so as to be vertically turnable around the pivot 23*b*.

In front of the image reading device 23, there is an operation panel unit 29 comprising various operation buttons and a LCD. On the upper surface of the image reading device 23, a glass plate 31 is provided for an original to be placed thereon when the cover 27 is opened upward. Under the glass plate 31, an image scanner (CIS: Contact Image Sensor) 33 for reading an original is provided reciprocatably along a guide shaft 35 extending in the main scanning direction (the Y-axis direction).

In the front portion of the housing 2 covered by the imaged reading device 23, an ink storage unit (not shown) is provided to be opened upward. In this ink storage unit, ink cartridges respectively storing one of four colors (black, cyan, magenta and yellow) for full-color printing are removably installed from above. In the MFD 1 of the present embodiment, ink stored in the ink cartridges is supplied to the recording head 15 through a plurality of ink supply tubes 37 connecting respective ink cartridges and the recording head 15.

Figure 3:
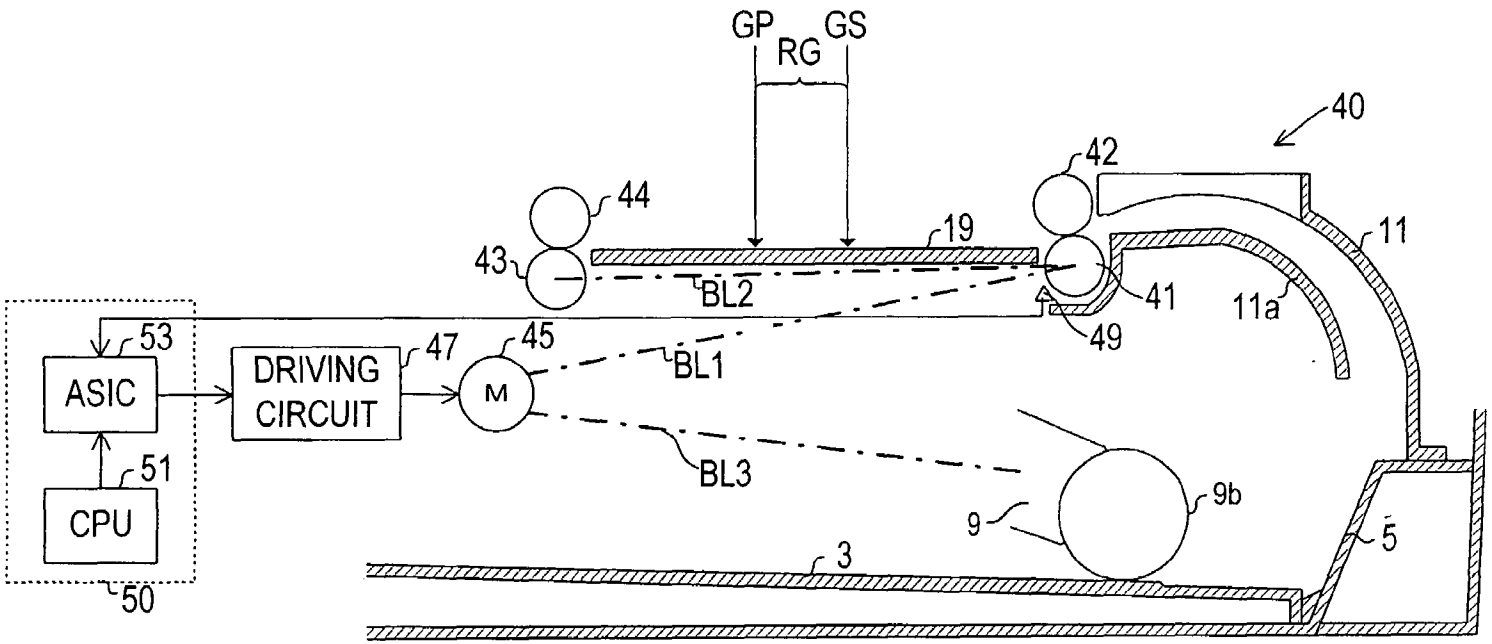
FIG. 3 is an explanatory view to show the structure of a conveyance unit and a conveyance control unit that constitute the conveyance system of the present invention.

The following describes a paper conveyance system of the MFD 1. FIG. 3 shows schematic structures of a conveyance unit 40 and a conveyance control unit 50 constituting the paper conveyance system of the MFD 1. In the drawing, the units in the MFD 1 that are already described with FIGS. 1 and 2 are diagrammatically illustrated for explaining the paper conveyance. For the same constituents already described in FIGS. 1 and 2, the same reference numerals are given in this drawing.

As shown in FIG. 3, the conveyance unit 40 of the MFD 1 comprises: the feed cassette 3; the feed unit 9 that separates the plurality of paper P stored in the feed cassette 3 in a sheet-by-sheet manner and that individually feeds paper P; a conveyance roller 41 that conveys paper P fed by the feed roller 9*b* of the feed unit 9 toward a location beneath the recording head 15; a pinch roller 42 facing and being pressed against the conveyance roller 41; an discharge roller 43 that assists paper conveyance during image formation and discharges paper P to the discharge unit 21 after image formation; a pinch roller 44 facing and being pressed against the discharge roller 43; the bank 5; the U-turn path 11; the platen 19 constituting a conveyance path of paper P together with the bank 5 and the U-turn path 11; a LF (Line Feed) motor 45 that is the driving source of the conveyance roller 41 and the discharge roller 43; transmission mechanisms BL1 and BL2 that are constituted with a belt, pulley and gear, and transmit the force generated by the motor 45; and a driving circuit 47 that drives the motor 45 based on various commands (control signals) inputted from the ASIC 53.

The upstream portion of the conveyance path constituted with the bank 5 and the U-turn path 11 limits the movement of paper P fed by the feed roller 9*b*, and guides the paper P to the contact point of the conveyance roller 41 and the pinch roller 42. Under the downstream portion (in regard to the conveyance direction of paper P) of the U-turn path 11, there is an assistant unit 11*a* provided to guide paper P to the contact point of the conveyance roller 41 and the pinch roller 42.

Accordingly, paper P fed from the feed cassette 3 is guided to the contact point between the conveyance roller 41 and the pinch roller 42 by the bank 5, U-turn path 11 and the assistant unit 11*a*. When paper P is guided to the contact point and the conveyance roller 41 makes a regular rotation in regard to the conveyance direction (counterclockwise rotation in FIG. 3), paper P is drawn between the conveyance roller 41 and the pinch roller 42, and held by these rollers. Subsequently, corresponding to the rotation of the conveyance roller 41, paper P is conveyed in the conveyance direction toward the discharge roller 43 for a distance corresponding to the amount of rotation of the conveyance roller 41.

The platen 19 constitutes the downstream portion of the conveyance path connecting the conveyance roller 41 and the discharge roller 43, and is disposed between the conveyance roller 41 and the discharge roller 43 along a line connecting these rollers. The platen 19 guides paper P sent from the conveyance roller 41 to an area wherein an image is formed by the recording head 15, and guides paper P, on which an image is formed, by the recording head 15 to a contact point between the discharge roller 43 and the pinch roller 44. Hereinafter, the end point in the downstream side of an image formation area RG, wherein image formation is conducted with various colors of ink, is referred to as an image formation point GP, and a point in the vicinity of the end point in the upstream side of the image formation area RG is referred to as a conveyance start point GS.

Paper P is conveyed toward the discharge roller 43 along the platen 19. When the leading end (the edge in the downstream side) of paper P reaches the contact point between the discharge roller 43 and the pinch roller 44, corresponding to the rotation of the discharge roller 43, paper P is drawn between the discharge roller 43 and the pinch roller 44 and held by these two rollers. Subsequently, corresponding to the further rotation of the discharge roller 43, paper P is conveyed in the conveyance direction toward the discharge unit 21 for a distance corresponding to the amount of rotation of the discharge roller 43 (the same amount as in the rotation of the conveyance roller 41). The above-described conveyance roller 41, discharge roller 43, pinch rollers 42 and 44, are all rotators respectively having a rotational axis in a direction perpendicular to the conveyance direction (main scanning direction). Paper P receives a driving force generated corresponding to the rotations of the conveyance roller 41 and the discharge roller 43 at the respective contact points with these two rollers. Paper P is conveyed in the conveyance direction along the conveyance path (i.e. from the upstream to downstream of the conveyance path) as described above.

The above-mentioned motor 45 is constituted with a DC motor and is driven by the driving circuit 47. The motor 45 provides rotational force thereof to the conveyance roller 41 via the transmission mechanism BL1 provided between the motor 45 and the conveyance roller 41. Consequently, the conveyance roller 41 is rotated. The rotational force transmitted to the conveyance roller 41 is furthermore transmitted to the discharge roller 43 via the transmission mechanism BL2 provided between the conveyance roller 41 and the discharge roller 43. Thus, the discharge roller 43 is rotated together with the conveyance roller 41 in the same direction. Still furthermore, the rotational force generated from the motor 45 is transmitted to the feed roller 9*b* via a transmission mechanism BL3 and the feed roller 9*b* is rotated thereby.

However, the feed roller 9*b* rotates in the conveyance direction of paper P only during a feeding process of feeding paper P toward the conveyance roller 41. During an image formation process, the feed roller 9*b* does not receive a rotational force from the motor 45 and therefore is idle. In other words, the transmission mechanism BL3 connecting the feed roller 9*b* and the motor 45 only transmits a rotational force to the feed roller 9*b* during the feeding process, but disengages gears installed therein and does not transmit the rotational force to the feed roller 9*b* during the image formation process.

When the feed roller 9*b* is rotated in the conveyance direction, the conveyance roller 41 and the discharge roller 43 are rotated in the opposite direction to the conveyance direction. That is, the transmission mechanism BL3 connecting the feed roller 9*b* and the motor 45 does not transmit the rotational force to the feed roller 9*b* when the motor 45 is regularly rotated. When the motor 45 is reversely rotated, the transmission mechanism BL3 converts the rotational force into a rotational force in the regular direction by the installed gears, and transmits the converted rotational force to the feed roller 9*b*.

It should be noted that the feed process mentioned herein indicates a process to rotate the feed roller 9*b* while being pressed against paper P, and to convey the leading end of paper P to a resist position that is the contact point with the conveyance roller 41 and the pinch roller 42. The image formation process herein indicates a process comprising: an initial conveyance process to convey the leading end of a drawing area of paper P placed at the resist position to the image formation point GP; and a subsequent main process to sequentially convey paper P so as to move a reference point, located at the conveyance start point GS, to the image formation point GP in every interval corresponding to the width of the image formation area RG in the conveyance direction, and to form an image on paper P by ejecting ink from the recording head 15 in conjunction with the conveyance of paper P. It is to be noted that the reference point of an object simply indicates a point on an object located at a position corresponding to the conveyance start point, but this does not mean that an object to be conveyed has a structure formed to be indicating this reference point.

The above-described conveyance unit 40 is provided with a rotary encoder 49 that outputs pulse signals every time the conveyance roller 41 rotates through a predetermined amount. Output signals from the rotary encoder 49 are inputted into the ASIC 53 of the conveyance control unit 50. In the present embodiment, the conveyance roller 41 and the discharge roller 43 are rotated by the motor 45, and the rotation of the motor 45 is also transmitted to the feed roller 9*b*. Consequently, in the MFD 1, it is possible to detect the rotational amount of the motor 45, conveyance roller 41, discharge roller 43, and the feed roller 9*b*, and to detect the travel distance (conveyance distance) of paper P conveyed by each roller (41, 43 and 9*b*) by detecting and counting the pulse signals from the encoder 49.

The conveyance control unit 50 connected to the driving circuit 47 of the conveyance unit 40 provides the driving circuit 47 with a command for the motor 45, and controls the rotation of the motor 45 constituting the conveyance unit 40. Additionally, the conveyance control unit 50 indirectly controls paper conveyance with the feed roller 9*b*, conveyance roller 41 and discharge roller 43. The conveyance control unit 50 mainly comprises the CPU 51 that controls the overall operation of the MFD 1, and the ASIC (Application Specific Integrated Circuit) 53 that controls the rotational speed and rotational direction of the motor 45.

FIG. 4 shows the structure of the conveyance control unit 50. The following only describes the control of paper conveyance during an image formation process (the main process). Thus, FIG. 4 shows only the constituents necessary for the motor control during the image formation process.

As described above, the paper conveyance during the image formation process is attained by paper P being sequentially conveyed for a predetermined distance in the sub-scanning direction (paper conveyance direction). Specifically, recording for one path of an image is conducted by the reciprocating recording head 15 in the main scanning direction. For further recording of subsequent paths, paper P is conveyed in the sub-scanning direction for a predetermined distance (conveyance distance Ds to convey paper P for one path that is the distance corresponding to the width of the image formation area RG in the conveyance direction shown in FIG. 3) and stopped. Subsequently, recording in the main scanning direction for the next path is conducted by the recording head 15. When this recording is finished, the paper P is still furthermore F conveyed in the sub-scanning direction for the predetermined distance for recording the following path and stopped. Then, recording in the main scanning direction is conducted by the recording head 15. That is, paper conveyance for a predetermined distance in the sub-scanning direction is repeated until the recording on to paper P is completed.

In the following, first, the structure of the driving circuit 47, which receives various commands from a drive signal generator 55 provided in the ASIC 53 of the conveyance control unit 50, is described and then the structure of the conveyance control unit 50 (especially the ASIC 53) is described based on FIG. 4.

Figure 5A:
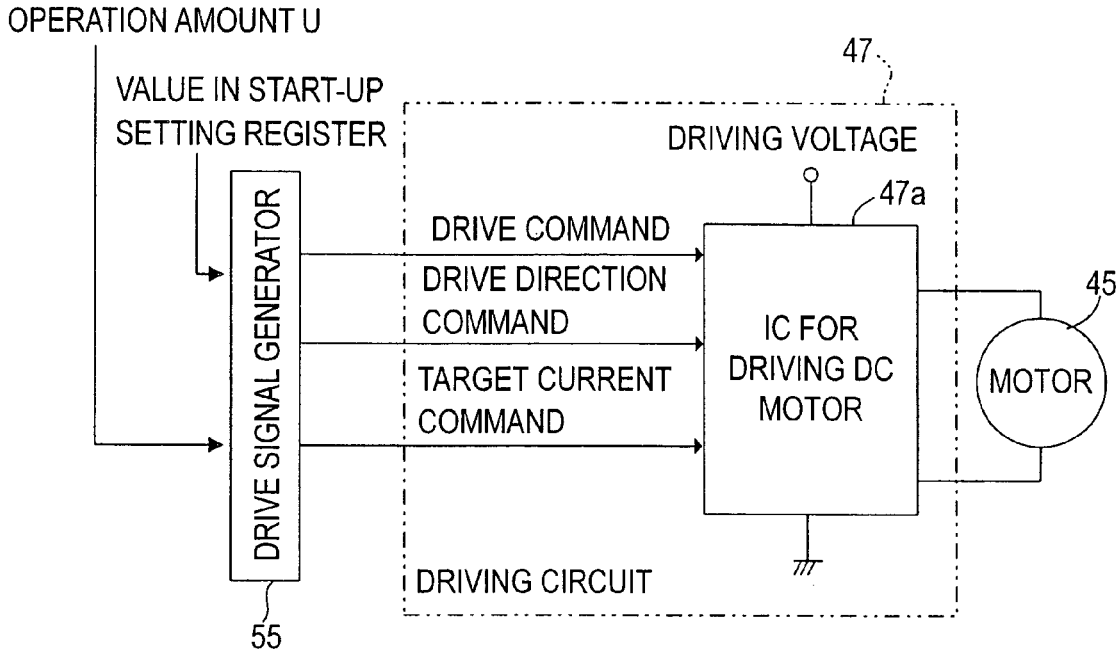
FIGS. 5A and 5B are explanatory views related to the structure of a driving circuit of the embodiment.
Figure 5B:
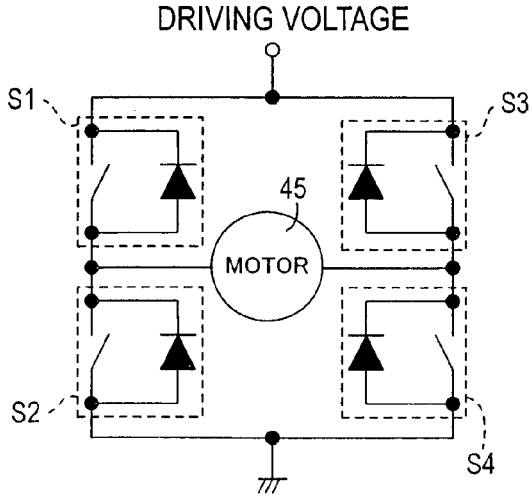

The structure of the driving circuit 47 is as shown in FIG. 5*a*. The driving circuit 47 starts the operation thereof upon receiving a drive command generated in the drive signal generator 55, and rotates the motor 45 in a driving direction (regular direction of the rotation of the motor 45) corresponding to a direction command from the drive signal generator 55. The rotation amount of the motor 45 is controlled based upon a target current command from the drive signal generator 55. More specifically, inside of IC 47*a* used for driving a DC motor, a H-bridge circuit is formed with switching elements (S1 to S4). The switching operation of each switching element (S1 to S4) is controlled based on a target current command from the drive signal generator 55. FIG. 5*b* shows an equivalent circuit of the IC 47*a* and the motor 45.

The drive signal generator 55 provided in the ASIC 53 provides the driving circuit 47 constituted as above with a drive command and a direction command, based on a preset value in the start-up setting register RS1. The drive signal generator 55 generates a target current command (control signal) based on an operation amount u (the target current value in the present embodiment) generated in the control unit 60 within the ASIC 53, and provides the command for the driving circuit 47.

Respective parts in the ASIC 53, such as the above-described drive signal generator 55, an encoder edge detection unit 56, a position counter 57, a cycle counter 58, a signal process unit 59, and the control unit 60, operate based on a clock signal with a cycle that is sufficiently shorter than the cycle of a pulse signal from the encoder 49 generated by a clock generator CLK of the ASIC 53.

The encoder edge detection unit 56 obtains pulse signals from the encoder 49 and detects edges of the pulse signals (for example, either or both of a leading edge or/and a trailing edge). The position counter 57 detects the rotation amount of the conveyance roller 41 as a count value y by counting the edges detected by the encoder edge detection unit 56.

The cycle counter 58 counts time (cycle length) between edges detected by the encoder edge detection unit 56. The signal process unit 59 conducts error handling and outputs interrupt signals to the CPU 51. The control unit 60 calculates an operation amount u to be inputted into the drive signal generator 55 based on various values of operation mode setting registers RS in the ASIC 53 and a count value y of the position counter 57, and conducts feedback control of the motor 45 for paper conveyance.

Figure 6:
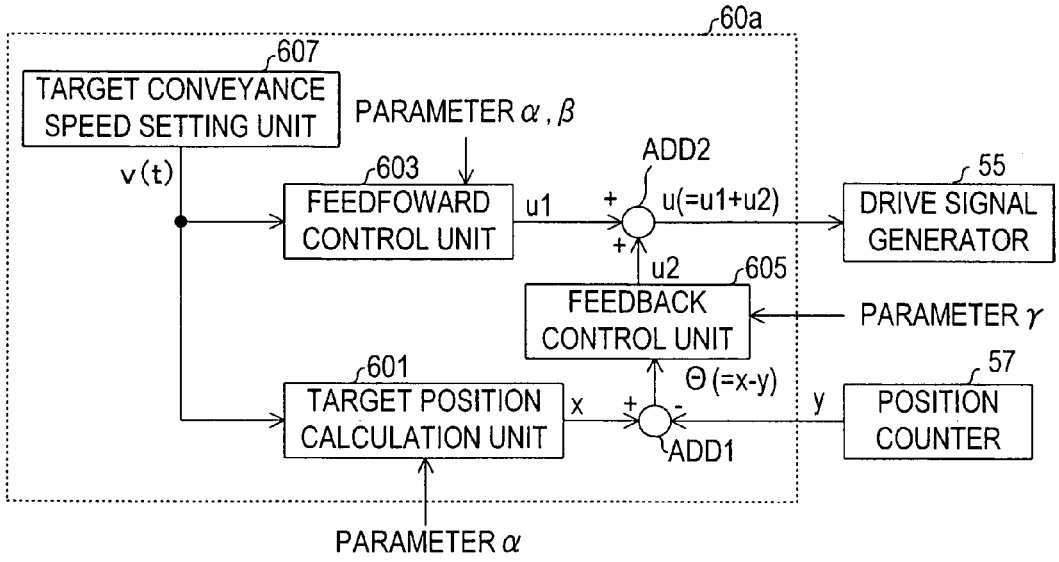
FIG. 6 is a block chart to show the structure of a feedback calculation process unit of the embodiment.

FIG. 6 shows a block diagram of the structure of a feedback calculation process unit 60*a* included in the control unit 60 of the ASIC 53. As shown in the drawing, the feedback calculation process unit 60*a* conducts feedback control so that the count value y of the pulse signals generated in the encoder 49 and obtained from the position counter 57 corresponds to a target position x calculated in a target position calculation unit 601. The feedback calculation process unit 60*a* comprises the target position calculation unit 601, a feedforward control unit 603, a feedback control unit 605, a target conveyance speed setting unit 607, a first adder ADD1 and a second adder ADD2.

The position counter 57 provided in the ASIC 53 is constituted to clear the count value y every time paper conveyance (the conveyance process) to convey paper P for one path is initiated. Consequently, the rotation amount of the conveyance roller 41 during conveyance control for one path can be obtained from the count value y in the position counter 57. The rotation amount of the conveyance roller 41 during the conveyance control for one path generally corresponds to the travel distance of paper P during the conveyance control for one path. Therefore, the count value y can be interpreted as a value indicating the conveyance distance (position) of a point of reference in paper P from the conveyance start point GS. The reference point is initially located at the conveyance start point GS when the conveyance control for one path is started.

Figure 7A:
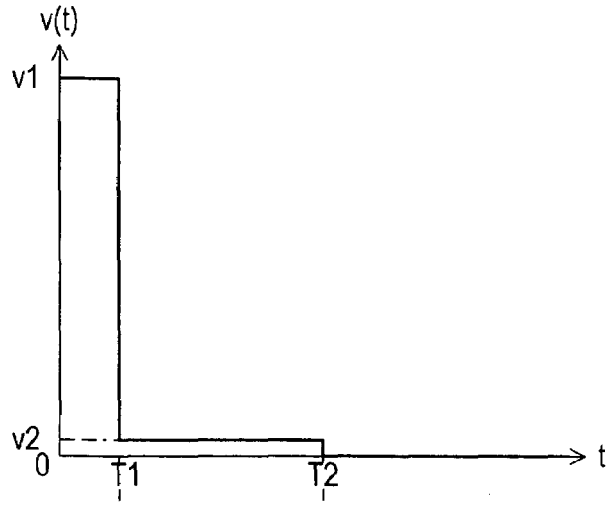
FIGS. 7A, 7B, and 7C, are graphs to show various responses produced when the motor is controlled by the feedback calculation process unit and the conveyance roller is operated.

The target conveyance speed setting unit 607 constituting the feedback calculation process unit 60*a* provides the target position calculation unit 601 and the feedforward control unit 603 with a target conveyance speed v (t) for conveyance control for one path based on a first target conveyance speed v1 and a second target conveyance speed v2 (cf. FIG. 7A). The first target conveyance speed v1 is a target conveyance speed stored in a first target speed setting register RS3 for the speed between an initiation of conveyance and the time T1 wherein predetermined switching timing comes. The second target conveyance speed v2 is a target conveyance speed stored in a second target speed setting register RS4 for the speed after time T1 passes until the conveyance for one path is finished (conveyance completion timing T2). The variable t indicates time.

The target position calculation unit 601 sets the target position x (t) based on the above-described target conveyance speed v (t) every time calculation timing comes. The calculation timing is determined from a value of a calculation cycle Ts stored in a calculation timing setting register RS10. The target position x (t) indicates target rotation amount of the conveyance roller 41 and the discharge roller 43, and generally corresponds to the target conveyance position of paper P.

In case the conveyance unit 40 operates according to a design value based on the target conveyance speed v (t) set in the target conveyance speed setting unit 607, at every calculation timing, the feedforward control unit 603 successively calculates an operation amount u1 (t) of the motor 45 in order to rotate the conveyance roller 41 and the discharge roller 43 so as to convey the paper P to the target position x (t), until the paper P is conveyed for a conveyance distance Ds and the conveyance (motor driving) is finished.

For example, when the relationship between the target conveyance speed v (t), and the target position x (t) calculated in the target position calculation unit 601, is expressed with a transfer function F1(s), and the relationship between the operation amount u1 (t) and the rotation amount x (t), in case the conveyance unit 40 operates according to a design value, is expressed with a transfer function P(s), the operation amount u1 (t) is obtained in the feedforward control unit 603 with a transfer function F2(s)=F1(s)/P(s) using the target conveyance speed v (t).

In the ASIC 53, a target locus setting register RS6 is provided in order to store a value of parameter α, constituting an arithmetic expression for extracting the target position x (t) from the target conveyance speed v (t). When the feedback calculation process unit 60*a* is operated, the value in the target locus setting register RS6 is extracted, and according to this value, transmission characteristics in the target position calculation unit 601 are determined.

Moreover, in the ASIC 53, a feedforward control setting register RS7 is provided in order to store a value of parameter β constituting an arithmetic expression for extracting the operation amount u1 (t) from the target conveyance speed v (t). When the feedback calculation process unit 60*a* is operated, the value in the feedforward control setting register RS7 is extracted, and according to this value and the value in the target locus setting register RS6, transmission characteristics in the feedforward control unit 603 are determined.

The above-described first adder ADD1 obtains an error Θ between the target position x (t) calculated in the above-described target position calculation unit 601 and the count value y in the position counter 57 from Θ=x·y, and provides this value Θ for the feedback control unit 605. The feedback control unit 605 calculates the correction amount u2 (t) of an operation amount based on the error Θ calculated in the first adder ADD1, and provides the correction amount u2 (t) for the second adder ADD2. The transmission characteristics are determined, in the same way as in the above-described target position calculation unit 601 and the feedforward control unit 603, by a value in a feedback control setting register RS8 that stores the value of parameter γ constituting a arithmetic expression for extracting the operation amount u2 (t) from the error Θ provided by the ASIC 53.

The second adder ADD2 adds the operation amount u1 (t) outputted from the feed forward control unit 603 and the operation amount u2 (t) outputted from the feedback control unit 605. Subsequently, the second adder ADD2 generates the operation amount u (t) that is necessary for the conveyance roller 41 and the discharge roller 43 to move paper P to the target position x (t), and provides the operation amount u (t) for the drive signal generator 55. The operation amount u (t) mentioned herein represents a target current value that should be applied to the motor 45.

Conveyance control to convey paper P for one path is attained as described above. That is, conveyance for one path is controlled: first, by the operation amount u calculated as above being inputted into the drive signal generator 55 at every calculation timing; second, by a target current command being regularly inputted into the driving circuit 47 based on this operation amount u; third, by the conveyance unit 40 being operated and the conveyance roller 41 and the discharge roller 43 being rotated for predetermined amount; and then, paper P is conveyed for one path. Correspondingly, a reference point of paper P located at the conveyance start point GS is conveyed to the image formation point GP.

Figure 7B:
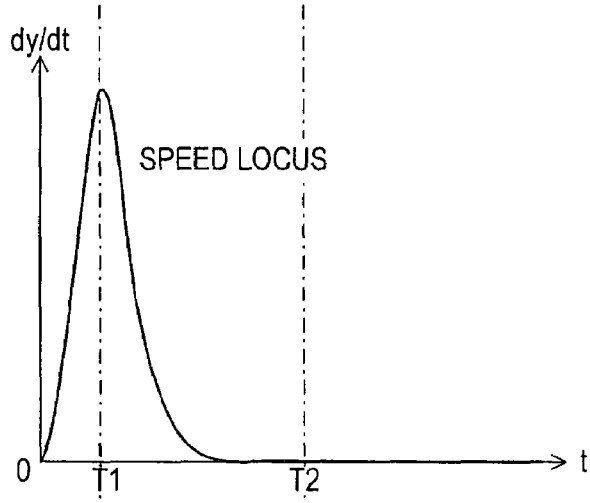
Figure 7C:
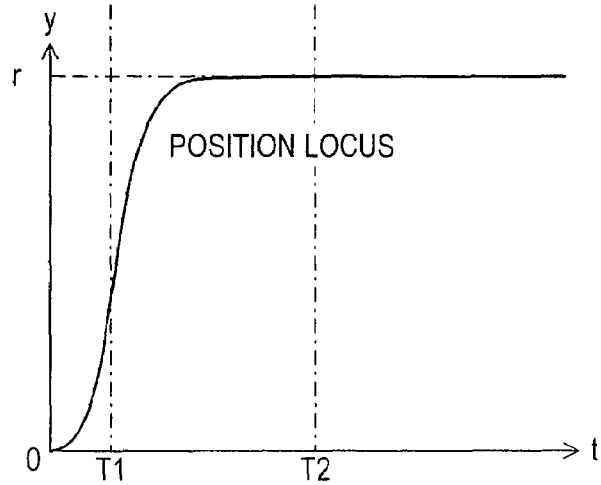
Figure 8:
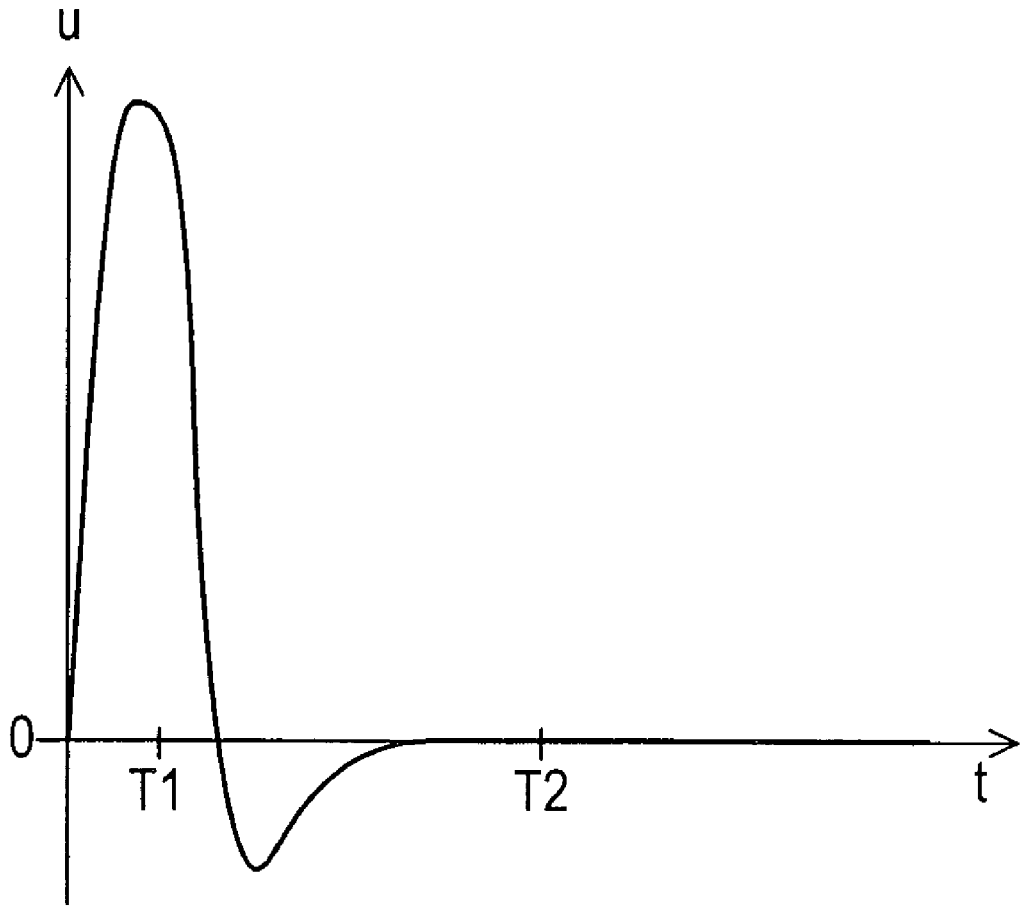
FIG. 8 is a graph to show the variation with time of operation amount u.

The following describes various responses produced when the motor 45 is driven and the conveyance roller 41 is rotated by the feedback calculation process unit 60*a*. FIG. 7B is a graph showing the locus of the rotational speed of the conveyance roller 41 and the discharge roller 43 (conveyance speed of paper P) that is attained when the target conveyance speed v (t) shown in FIG. 7A is set. FIG. 7C is a graph showing the locus of the rotation amount of the conveyance roller 41 and the discharge roller 43 (the count value y in the position counter 57). FIG. 8 is a graph showing the variation with time of the operation amount u in the above-described status.

Figure 9A:
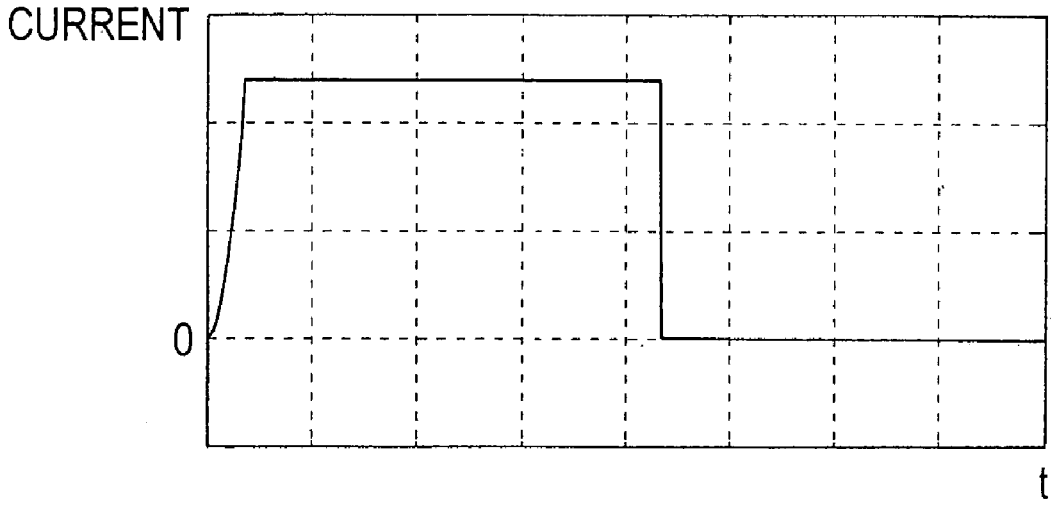
FIGS. 9A and 9B are graphs to show the variation with time of current value (9A) and the variation with time of target position and count value (9B) for a case in which control is conducted according to a conventional method when the operation amount exceeds an upper limit.
Figure 9B:
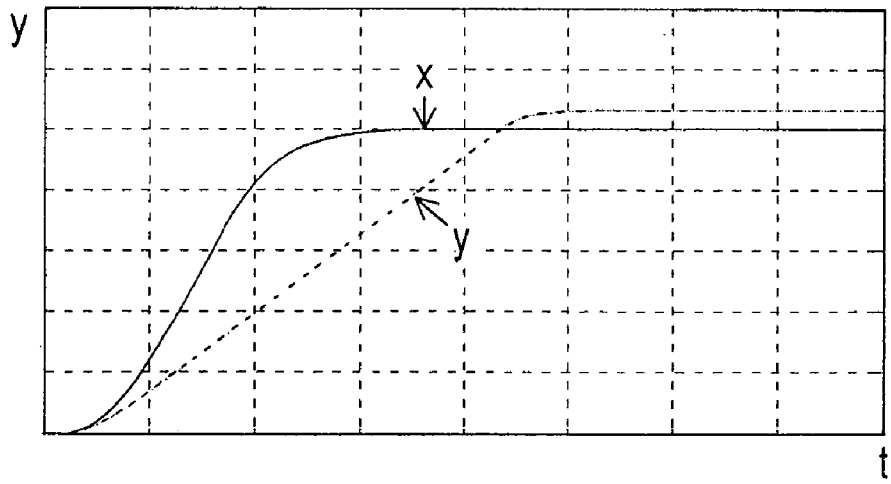
Figure 10A:
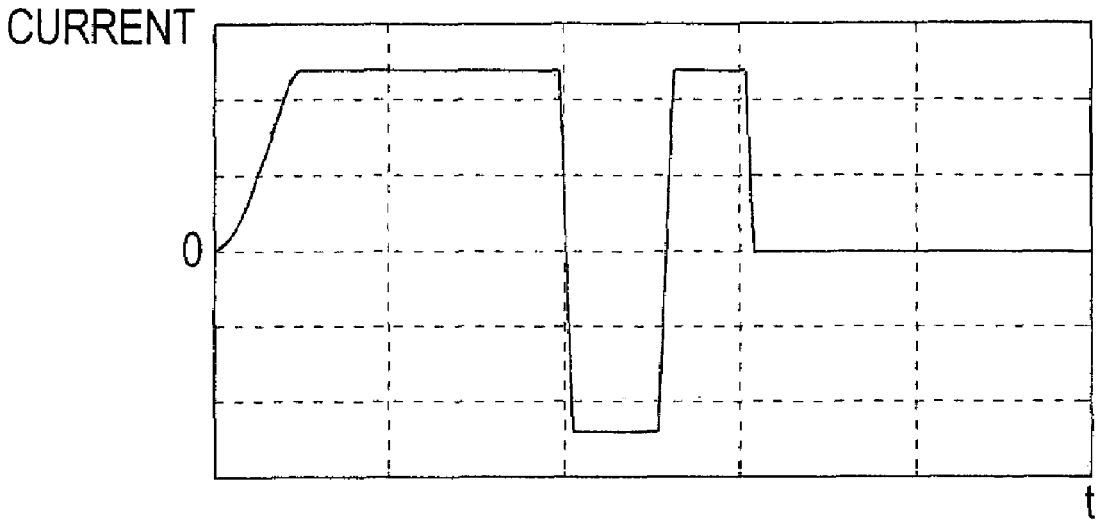
FIGS. 10A and 10B are graphs to show the variation with time of the current value (10A) and the variation with time of the target position and the count value (10B) for a case in which control is conducted according to a conventional method when the operation amount exceeds the upper limit.
Figure 10B:
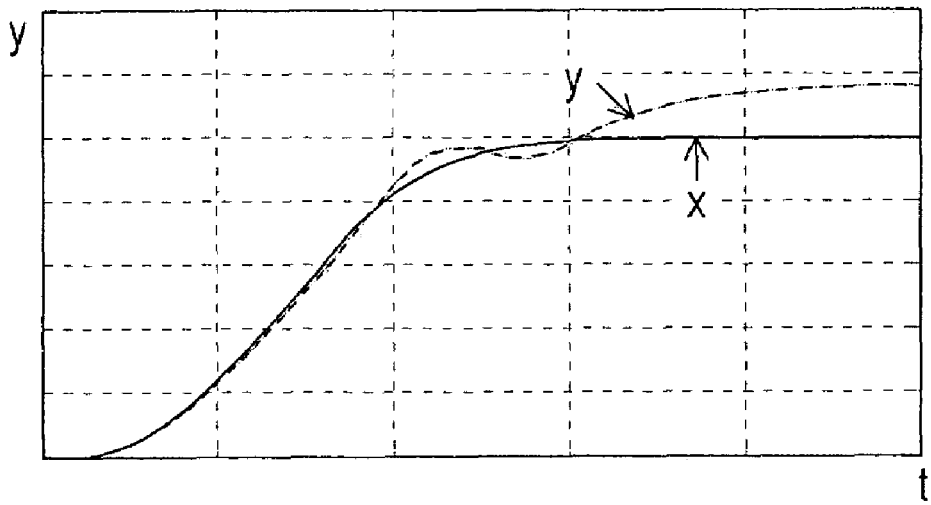

As shown in FIG. 8, when rotation of the motor 45 is initiated, the operation amount u (target current value) once increases in a positive direction, then changes toward the negative direction, and finally converges at an extremely small value in the vicinity of "0". Corresponding to the operation value u changing as above, the rotational amount of the conveyance roller 41 (more specifically, the count value y in the position counter 57) gradually increases and reaches a stop position r as shown in FIG. 7C. The rotational speed of the conveyance roller 41 once increases immediately after the rotation is initiated, and then gradually decreases to converge at "0" as shown in FIG. 7B, In the driving circuit 47, there is a limit to an attainable current value. Therefore, even when the operation amount u exceeding a predetermined upper limit is inputted from the feedback calculation process unit 60*a*, the target current value does not exceed the upper limit. In other words, when the operation amount u exceeds the upper limit, the current value attained in the driving circuit 47 is saturated at the upper limit as shown in FIGS. 9A and 10A. FIGS. 9A, 9B, 10A and 10B show the variation with time of the current value when the operation amount u exceeds the upper limit and control is conducted according to a conventional method (FIGS. 9A and 10A), and also show the variation with time of corresponding target position x (t) and count value y (FIGS. 9B and 10B).

Accordingly, when a load on paper P is large and the operation amount U exceeds the upper limit, continuing the operation of the feedback calculation process unit 60*a* results in the error Θ between the target position x (t), calculated by the target position calculation unit 601, and the count value y in the position counter 57 being enlarged to make the operation amount u2 (t) larger. This results in a status wherein the operation amount u exceeding the upper limit (i.e. status wherein current value is saturated) is continued.

In this kind of case, since the rotational speed of the conveyance roller 41 and the discharge roller 43 and the conveyance speed of paper P in the vicinity of the image formation point GP is too high, despite the motor 45 being short-circuited to finish the conveyance operation (despite the stopping of the driving of the conveyance roller 41 and the discharge roller 43), the amount of rotation of the conveyance roller 41 and the discharge roller 43 through inertia is large. Hence, the conveyance roller 41 and the discharge roller 43 are rotated more than necessary and then stopped. Moreover, paper P is moved to a large extent by inertia and stopped at a position more toward the downstream than the image formation point GP.

That is to say, in a conveyance system of the MFD 1, when the load applied to paper P (rotational load on the motor 45) is large, if the status wherein the operation amount u exceeds the upper limit is not promptly resolved, then the paper P cannot be accurately conveyed to the image formation point GP.

Additionally, there are some cases wherein the operation amount u naturally falls below the upper limit when a load on a paper P is decreased. In this case, at the moment when the load on the paper P decreases, the driving force works more than necessary on the conveyance roller 41, the discharge roller 43 and paper P, and rotates the conveyance roller 41 and the discharge roller 43 so as to convey the paper P beyond the target position x (t). Consequently, as shown in FIG. 10A, the operation amount u extracted in the feedback calculation unit 60*a* and the current value attained in the driving circuit 47 largely pulsate in the plus direction and the minus direction. Therefore, the conveyance of the reference point of paper P to the image formation point GP cannot be conducted accurately.

Figure 11:
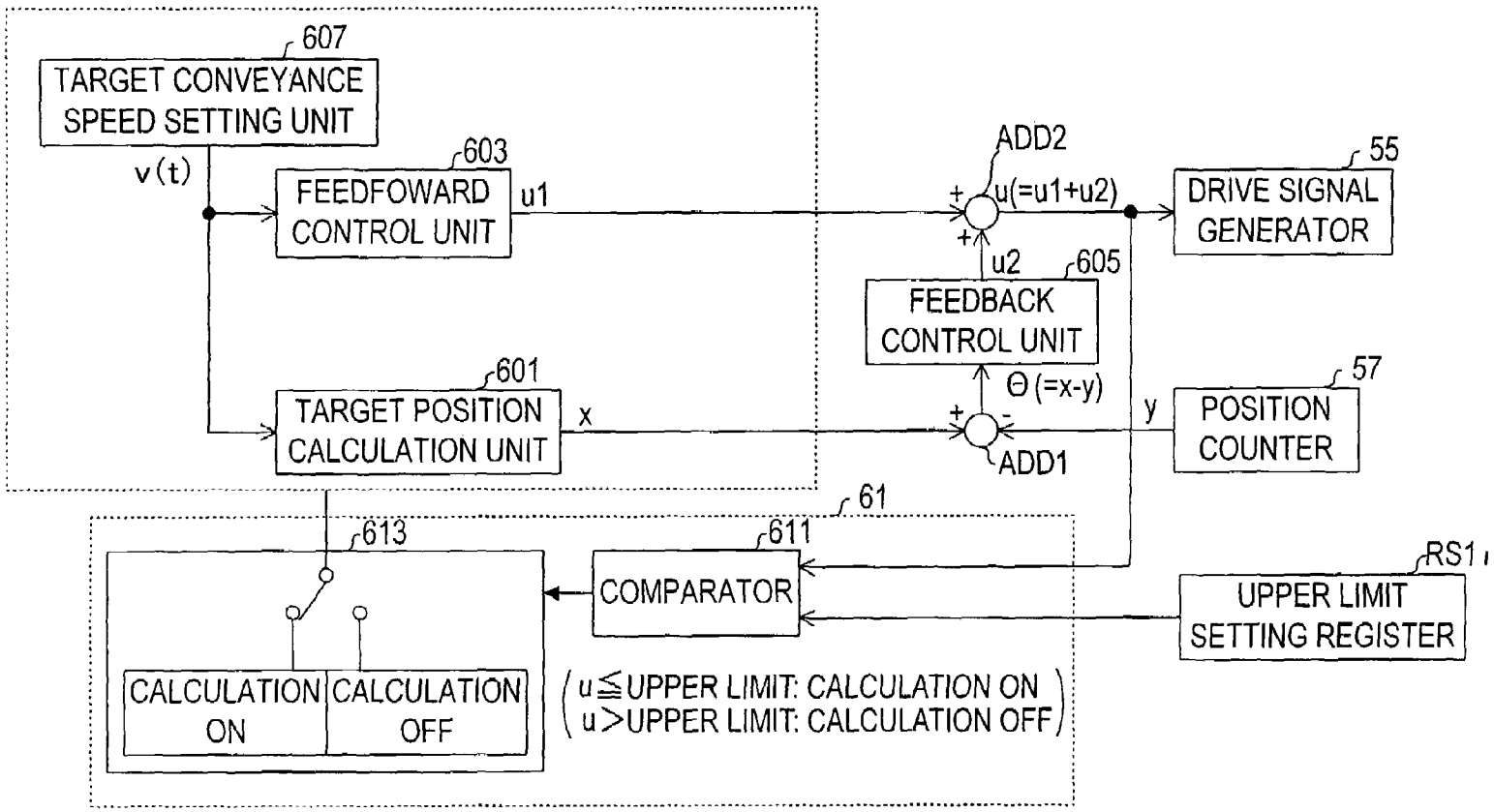
FIG. 11 is a block diagram to show the structure of a switching process unit of the embodiment.

In order to solve problems like these, the control unit 60 of the MFD 1 is provided with a switching process unit 61 that switches control methods based on a value in an upper limit setting register RS11 that stores the value for the upper limit of operation amount u, and based on a value of the operation amount u outputted from the second adder ADD2. FIG. 11 shows a block diagram showing the structure of the switching process unit 61.

As shown in FIG. 11, the switching process unit 61 comprises a comparator 611 and an on/off control unit 613. The on/off control unit 613 switches on/off the operation of the target position calculation unit 601, the feedforward control unit 603, and the target conveyance speed setting unit 607, based on a command from the comparator 611. The comparator 611 determines whether or not the operation amount u is equal to or larger than the upper limit. Comparing the upper limit maintained in the upper limit setting register RS11 and the latest operation amount u outputted from the second adder ADD2, the comparator 611 provides an on-command for the on/off control unit 613 when the operation amount u is less than the upper limit, and provides an off-command when the operation amount u is equal to or larger than the upper limit. The target position calculation unit 601, the feedforward control unit 603, and the target conveyance speed setting unit 607, are switched on when conveyance control is initiated.

Accordingly, when conveyance control is initiated, the feedback calculation process unit 60*a* calculates the operation amount u1 (t) and the target position x (t) based on the target conveyance speed v (t), and calculates the operation amount u based on the result of the above-described calculation and the count value y in the position counter 57.

In case the load is large and the operation amount u reaches the upper limit and goes beyond the limit as time passes, the operation of the target position calculation unit 601, the feedforward control unit 603, and the target conveyance speed setting unit 607 are switched off.

When a calculation timing comes while these units are in an off-status, the first adder ADD1 of the feedback calculation process unit 60*a* obtains the error Θ between a value x(Tb) calculated and maintained by the target position calculation unit 601 at a calculation timing immediately before the switch-off, and the current count value y in the position counter 57 (i.e. Θ=x(Tb)·y). The feedback control unit 605 calculates the operation amount u2 (t) based on this error Θ. The second adder ADD2 adds the value u1(Tb) calculated and maintained by the feedforward control unit 603 at the calculation timing immediately before the switch-off and the above-described operation amount u2 (t) calculated by the feedback control unit 605, generates the operation amount u (t)=u1(Tb)+u2 (t), and provides the operation amount u2 (t) for the drive signal generator 55.

In conducting control with this status, as the error Θ becomes smaller and the operation amount u (t) falls below the upper limit, at a calculation timing subsequent to the calculation timing wherein the operation amount u (t) becomes below the upper limit (time t=Tc), the operation of the target position calculation unit 601, the feedforward control unit 603, and the target conveyance speed setting unit 607, are once again switched on. In the feedback calculation process unit 60*a*, the operation amount u1(t−(Tc−Tb)) and the target position x(t−(Tc−Tb)) based on the target conveyance speed v(t−(Tc−Tb)) are calculated. Based on the result of this calculation and the count value y in the position counter 57, the operation amount u (t) is calculated. In other words, the target position calculation unit 601 and the feedforward control unit 603 calculate the target position x and the operation amount u1 after the delay for the length of time in the off-status of theses units, The second adder ADD2 calculates the operation amount u with these values, and outputs the operation amount u.

Figure 12A:
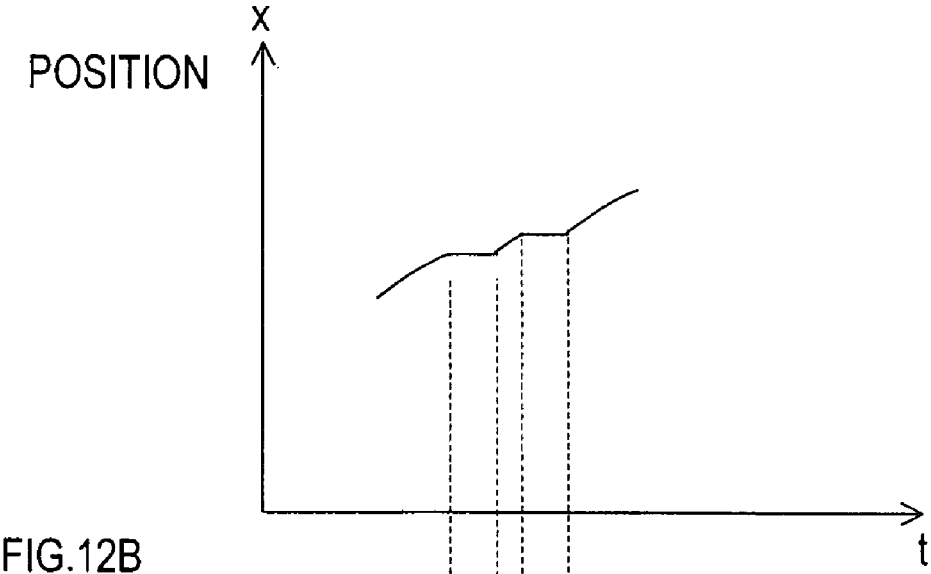
FIGS. 12A and 12B are graphs to show the variation with time of the target position (12A) and the variation with time of the current value (12B) for a case in which control is conducted according to a method of the embodiment of the present invention when the operation amount exceeds the upper limit.
Figure 12B:
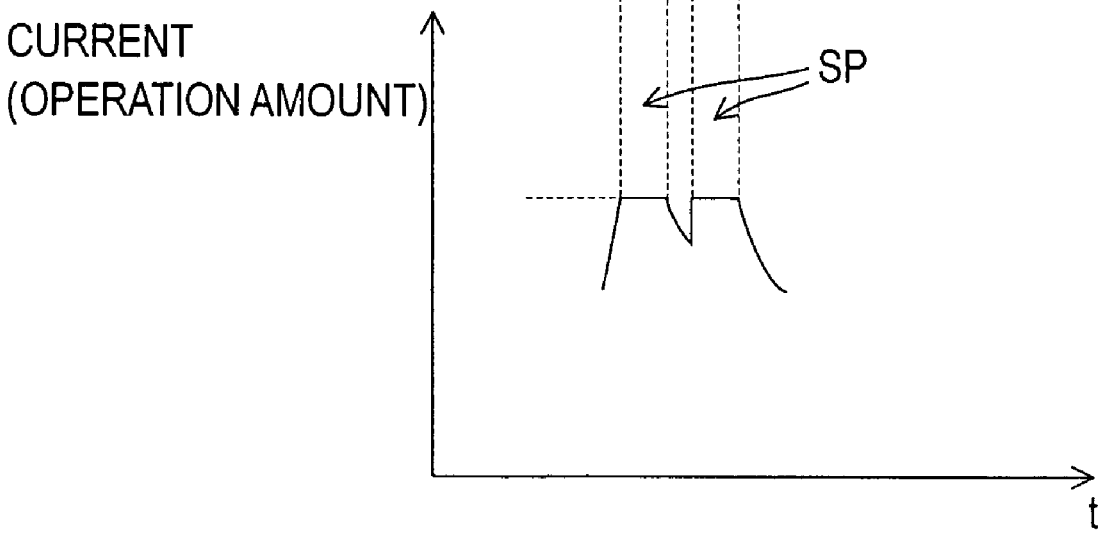
Figure 13A:
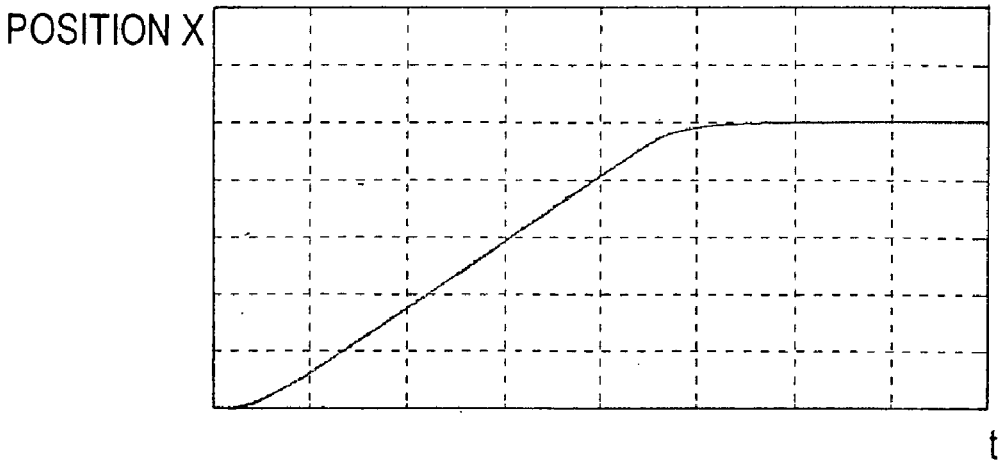
FIGS. 13A and 13B are graphs to show the variation with time of the target position (13A) and the variation with time of the current value (13B) for a case in which control is conducted according to a method of the embodiment of the present invention when the operation amount exceeds the upper limit.
Figure 13B:
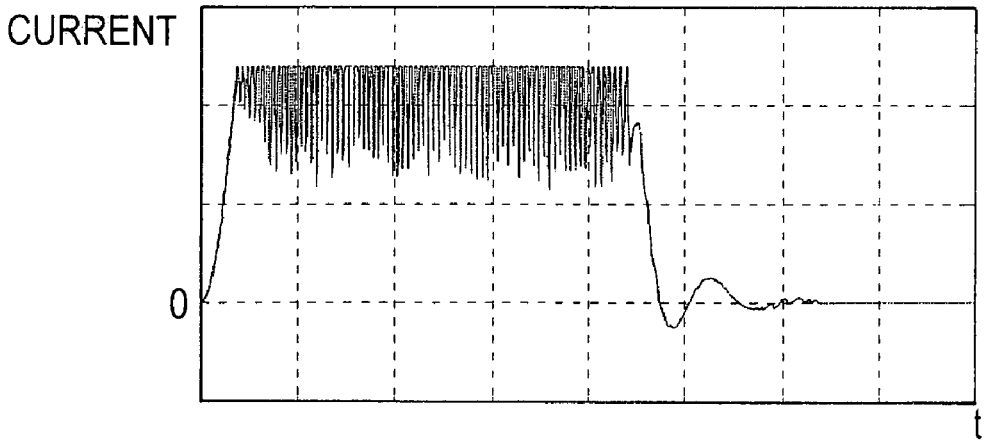

FIGS. 12A, 12B, 13A, and 13B, respectively show graphs wherein the variation with time of the target position x in a case in which control is conducted according to the present method is shown (FIGS. 12A and 13A), and wherein the variation with time of the current value, which is correspondingly attained in the driving circuit 47 (and indirectly indicates the operation amount u), is shown (FIGS. 12B and 13B). Since the MFD 1 of the present embodiment comprises the switching process unit 61, it is possible to shorten a period SP wherein the operation amount u is above the upper limit. Hence, even when the load on paper P is large, the MFD 1 of the present embodiment can accurately convey paper P so as to move the reference point to the image formation point GP.

Figure 14:
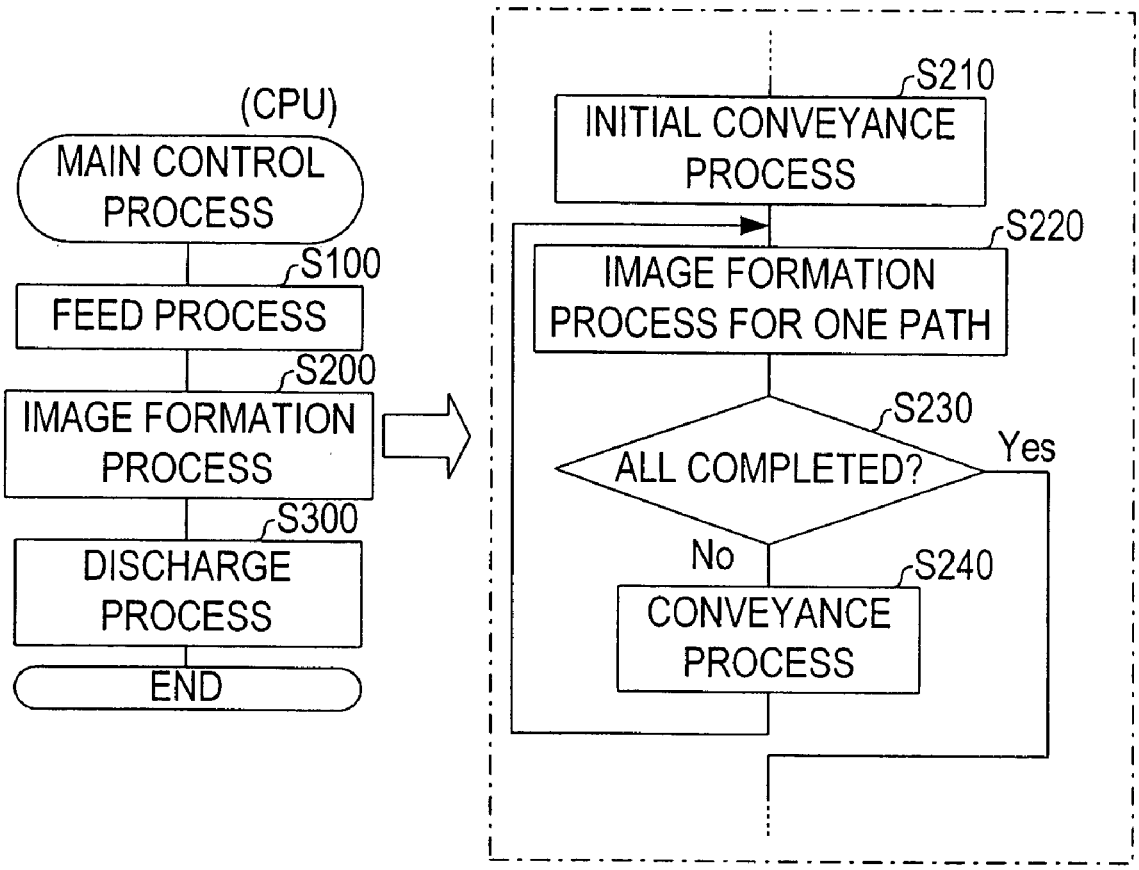
FIG. 14 is a flowchart to show a main control process conducted by the CPU of the embodiment.

The above has described the operation of the ASIC 53 in conveyance control so as to convey paper P for one path. In the present MFD 1, main control, such as feed process, image formation process, and discharge process, is conducted in the CPU 51. FIG. 14 shows a flowchart describing the main control processes that the CPU 51 conducts. The main control process is conducted by the CPU 51 when an image formation command is inputted into the CPU 51 from a personal computer (PC) connected to the MFD 1 or from the operation panel 29.

When the main control process is initiated, in S100, register setting in connection with feed operation is conducted on the ASIC 53 by the CPU 51. Consequently, in the ASIC 53, processes in connection with feed operation are conducted, and in the conveyance unit 40, the paper P is conveyed to the resist position (feed process). When this feed process is finished in S200, the image formation process is subsequently conducted.

When the image formation process is initiated, in S210 the initial conveyance process is conducted by the CPU 51 and based on control by the ASIC 53, the start point of the drawing area in paper P is conveyed to the image formation point GP. When this process is finished, in S220, the image formation process for one path of an image is conducted by the CPU 51.

The image for one path is formed on the paper P by the carriage 17 moving in the main scanning direction, and ink being ejected from the recording head 15.

When this process is over, in S230, a determination is made by the CPU 51 as to whether or not image formation is finished up to the end point of paper P. When the CPU 51 determines that image formation is not yet finished (S230: NO), the process proceeds to S240 and the conveyance process is conducted by the CPU 51 (S240). A recording area for next path is conveyed to the image formation area RG (i.e. the reference point of paper P located at the conveyance start point GS is conveyed to the image formation point GP). Subsequently, the process goes back to S220 and the image formation process for another path is conducted.

On the other hand, when it is determined that image formation is finished up to the end point of the paper P (S230: YES), the process proceeds to S300 wherein the discharge process is conducted by the CPU 51 and, based on control by the ASIC 53, the paper P is discharged to the discharge unit 21.

Figure 15:
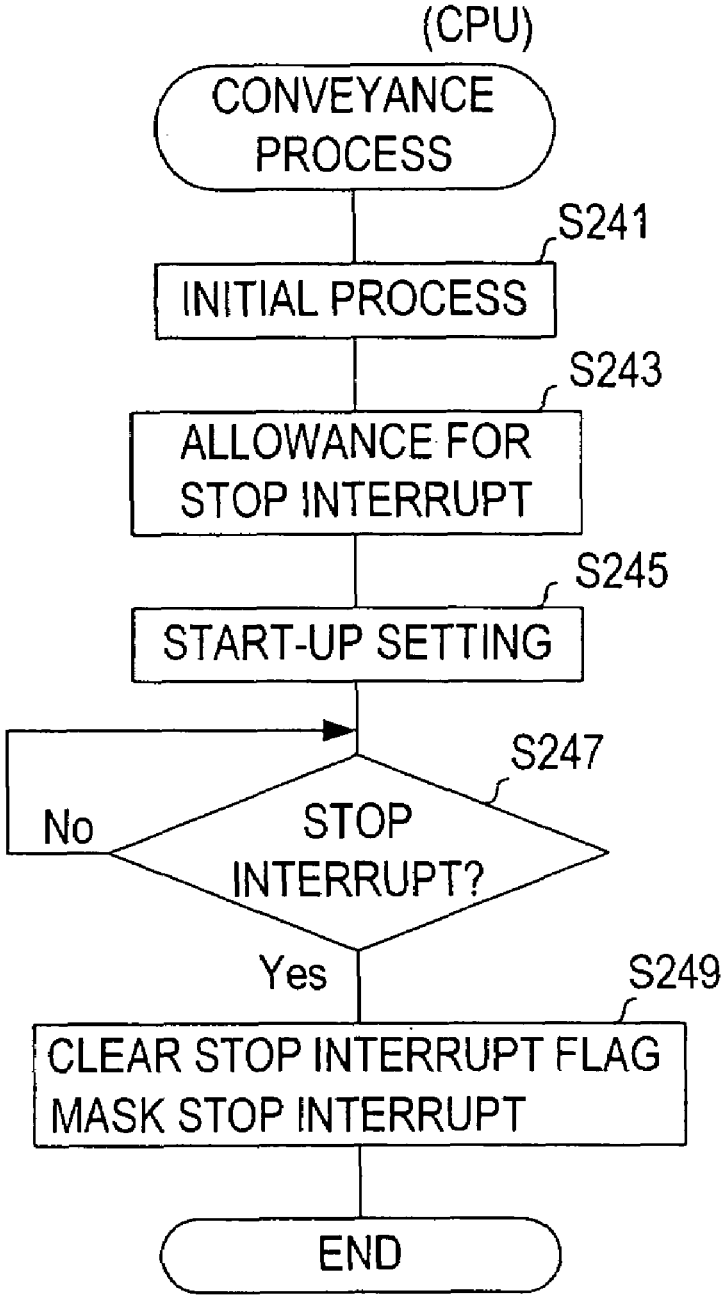
FIG. 15 is a flowchart to show a conveyance process conducted by the CPU of the embodiment.

FIG. 15 shows a flowchart describing the conveyance process conducted in S240. In S241 of the conveyance process, an initial process on the ASIC 58 is conducted (S241). In this initial process, setting is conducted for respective registers constituting the operation mode setting registers RS. When this process is finished, in S243 by an operation of the CPU 51, an allowance for stop interrupt is issued from the CPU 51 to the ASIC 53. As a result, the ASIC 53 becomes capable of outputting a stop interrupt signal.

Upon receiving the allowance for stop interrupt, the ASIC 53 detects, using the signal process unit 59, every status wherein paper P reaches the target stop position r set in the target stop position setting register RS 9 (i.e. every time the count value y in the position counter 67 becomes equal to or more than the value for the target stop position r), and provides a stop interrupt signal for the CPU 51. Even when the count value y in the position counter 57 does not go beyond the count value for the target stop position r, if the count value y in the position counter 57 does not change for certain period of time the ASIC 53 also provides a stop interrupt signal for the CPU 51. The target stop position r set in the target stop position setting register RS9 represents a point wherein the driving of the motor 45 is stopped.

Figure 16:
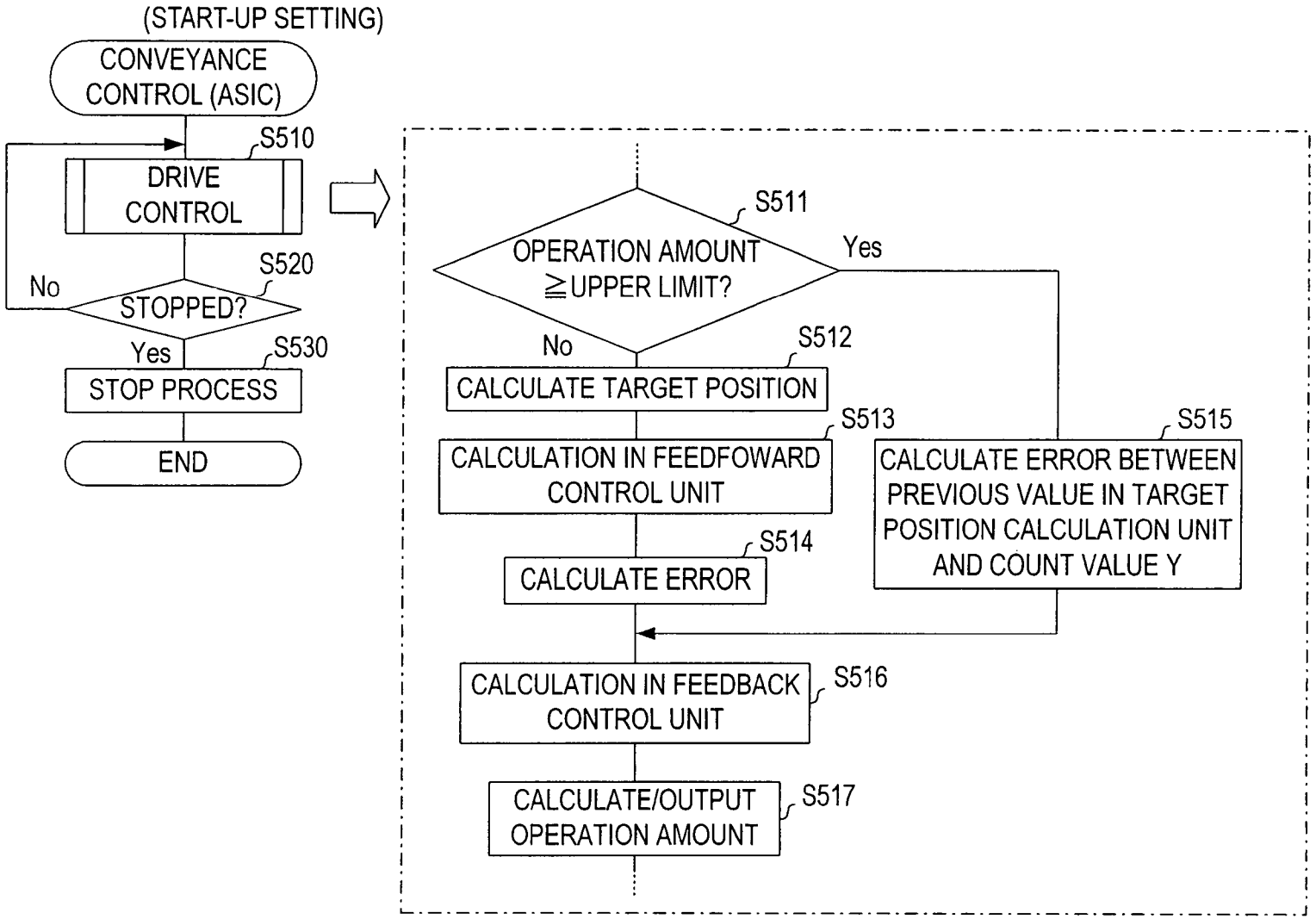
FIG. 16 is a flowchart to show a conveyance control process to convey paper for one path conducted by ASIC of the embodiment.

When the process in S243 is finished, in S245, start-up setting on the ASIC 53 is conducted by the CPU 51. That is, the setting in the start-up setting register RS1 by the CPU 51 triggers the initiation of calculations for the operation amount u in the ASIC 53. The driving of the motor 45 and the corresponding paper conveyance for one path conducted by the rotation of the conveyance roller 41 and the discharge roller 43 are subsequently initiated. The motor control of the motor 45, initiated after the start-up setting (conveyance control for one path: c.f. FIG. 16), is basically conducted by the ASIC 53. The CPU 51 stands by, in S247, waiting for a stop interrupt signal.

When a stop interrupt signal is inputted from the ASIC 53, the CPU 51 clears the stop interrupt flag. Additionally, a masking process against the stop interrupt is conducted so as to block further stop interrupt signals. Subsequent to receipt of the interrupt signal, the process proceeds to S220 and the image formation process for one path is conducted as described above.

FIG. 16 is a flowchart describing the conveyance control process for one path conducted by the ASIC 53. Although motor control (conveyance control for one path) by the ASIC 53 is conducted as the operation of hardware as described above, the operation of hardware is put into a flowchart herein for description.

When start-up setting is done and conveyance control for one path is initiated, in S510, the ASIC 53 initiates driving control for the motor 45. In this step, calculation for the operation amount u by the feedback calculation process unit 60*a* and motor control on the motor 45 based thereon are repeated until conveyance termination timing T2 to convey paper P for one path comes and the motor 45 is short-circuited.

Subsequently, when paper P reaches the target stop position r that is before the conveyance destination (image formation point GP) for predetermined distance, the conveyance termination timing T2 cones (S520:YES). The motor 45 is short-circuited, the rotation thereof is braked, and the rotation of the motor 45 is stopped. Consequently, paper P is moved for the conveyance distance Ds for one path, and the reference point of paper P, located at the conveyance start point GS previous to conveyance control, reaches the image formation point GP.

When the rotation of the conveyance roller 41 and the discharge roller 43 as well as the rotation of the motor 45 is stopped, in S530, the ASIC 53 provides a stop interrupt signal for the CPU 51. Subsequently, the ASIC 53 terminates conveyance control to convey paper P for one path.

In S510, the target conveyance speed v (t) is determined based on a first target conveyance speed v1 maintained in a first target speed setting register RS3 and a second target conveyance speed v2 maintained in a second target speed setting register RS4. In S512, the target position x (t) corresponding the obtained target conveyance speed v (t) is set by the target position calculation unit 601. In S513, the operation amount u1 (t) corresponding to the above-described target conveyance speed v (t) is calculated by the feedforward control unit 603.

In S514, the first adder ADD1 calculates the error Θ based on the target position x (t) calculated by the target position calculation unit 601 in S512 and the count value y in the position counter 57. In S516, the feedback control unit 605 calculates the operation amount u2 (t) based on the error Θ. In S517, the second adder ADD2 calculates the operation amount u (t) based on the operation amount u1 (t) calculated in S513 and the operation amount u2 (t) calculated in S516. The obtained operation amount u (t) is outputted to the drive signal generator 55. Consequently, the conveyance roller 41 and the discharge roller 43 are rotated at a rotational speed corresponding to the operation amount u. Paper P is conveyed at a speed corresponding to the rotational speed.

However, the above-described processes in S512 to S517 are conducted only when the comparator 611 outputs an on-command, that is when the operation amount u (t) from a previous output is less than the upper limit and only at the first calculation timing after conveyance control is initiated.

If the operation amount u is equal to or more than the upper limit (S511:YES), the comparator 611 outputs an off-command. Thus, the processes in S512 to 514 are not conducted at next calculation timing (i.e. the setting of the operation amount u1, the setting of the target position x, and the calculation of the error Θ, which are usually conducted as routine, are not conducted). In S515, the position obtained from the previous calculation in S512 is used as the target position x. Based on the value of this target position x and the current count value y in the position counter 57, the error Θ is obtained. Subsequently, in S516, the operation amount u2 is obtained in the feedback control unit 605 based on the error Θ. In S517, the operation amount u for this time is determined based on the operation amount u2 obtained in S516 and the latest operation amount u1 calculated in S513. The operation amount u is inputted into the drive signal generator 55.

In the present embodiment, speed in the positive direction is set for the target conveyance speed v (t), but speed is not set in the negative direction. The target position x (t) is set in the target position calculation unit 601 according to the inclination corresponding to the target conveyance speed v (t) (the variation of the target conveyance speed v (t)). Thus, the target position x (t) is set more toward the downstream than the previously set target position. In case a previous operation amount u is equal to or more than the upper limit (S511:YES), the target position x (t) is set more toward the upstream in the conveyance direction than a usual case (wherein the operation amount u is less than the upper limit).

Accordingly, in the MFD 1 of the present embodiment, it is possible to resolve the status wherein the drive circuit 47 is more promptly operated with the maximum current, as compared to a case wherein an on-off control is not conducted in the switching process unit 61. Consequently, it is possible to inhibit unnecessary driving force from being applied to the conveyance roller 41, discharge roller 43 and paper P, and to conduct highly accurate conveyance (rotation) control.

According to the present embodiment, paper P is conveyed for a predetermined conveyance distance Ds, and a reference point thereof can be conveyed to a target position (image formation point GP). Hence, in a series of image formation attained on a paper P by paper conveyance, it is possible to conduct image formation at predetermined positions with high levels of accuracy, and therefore inhibit the deterioration in image quality that could be caused in the form of lines of print gaps or overlapping of ink.

The above has described an example to resolve the status wherein the operation amount u exceeds the upper limit by temporarily stopping calculations in the target position calculation unit 601 and the feedforward control unit 603. It goes without saying that the above-described method can be applied to a case wherein the operation amount u is saturated at the upper limit. The status wherein the operation amount u exceeds the upper limit may be also resolved by decreasing the target conveyance speed.

Second Embodiment

Figure 17:
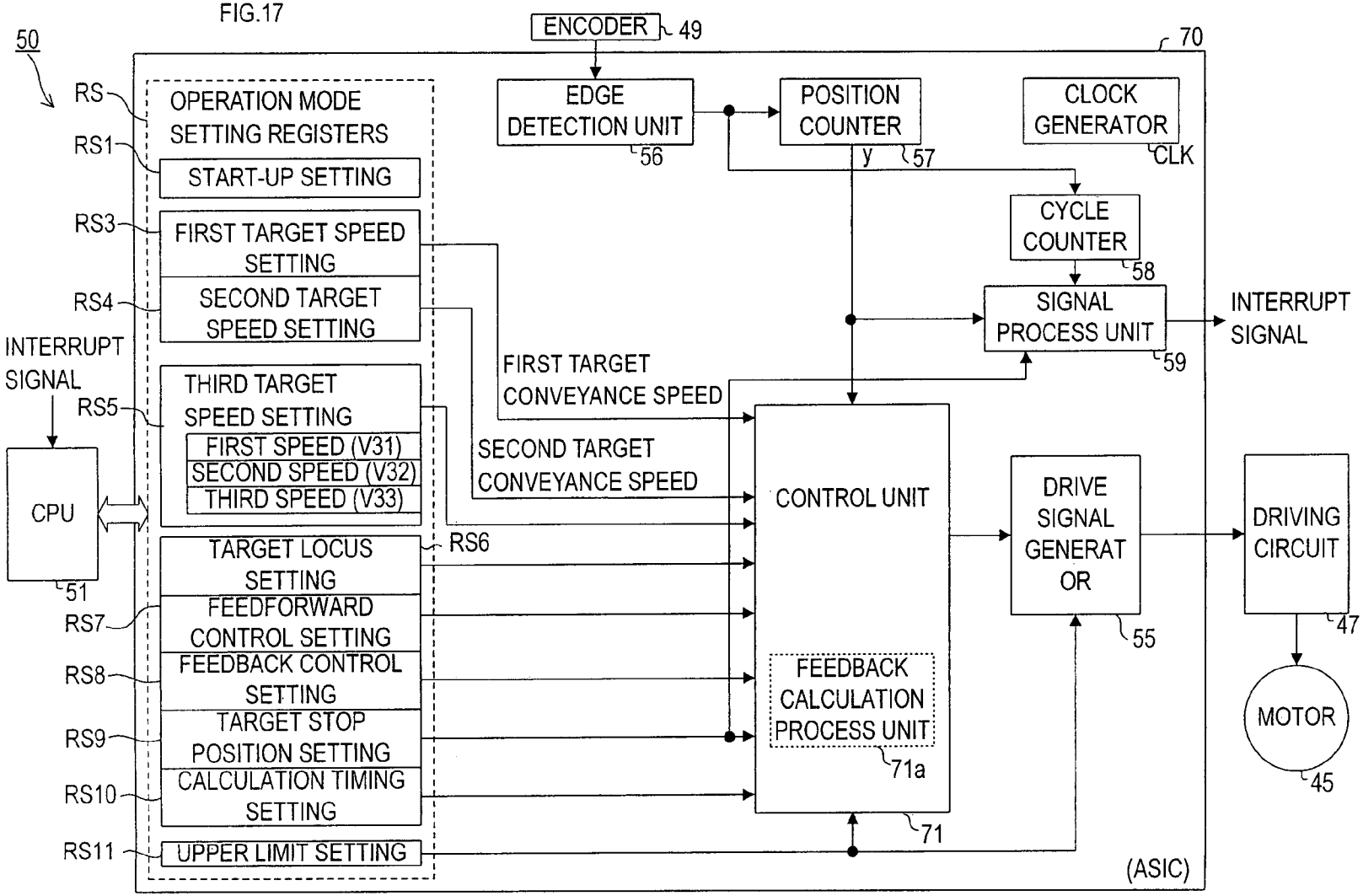
FIG. 17 is a block diagram to show the structure of ASIC of another embodiment.

FIG. 17 shows a block diagram illustrating the structure of ASIC 70 of another embodiment. The ASIC 70 of this embodiment has a structure only partly different from the structure of the ASIC 53. The same constituents used in the ASIC 53 are given the same reference numerals, and a description thereof is not repeated.

In addition to the constituents of the ASIC 53, the ASIC 70 shown in FIG. 17 comprises a third target speed setting register RS5. In the third target speed setting register RS5, the third target conveyance speed is stored The third target conveyance speed is set to replace the first target conveyance speed v1 stored in the first target speed setting register RS3 when the operation amount u becomes equal to or more than the upper limit. Specifically, a plurality of values v31, v32, and v33, are maintained as the third target conveyance speed in the third target speed setting register RS5. Theses values v31, v32, and v33, satisfy a relational expression v1>v31>v32>v33>v2.

Figure 18A:
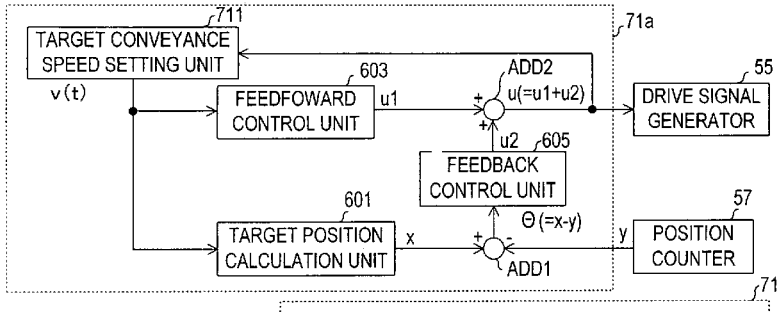
FIGS. 18A and 18B are block diagrams to show the structure of a feedback calculation process unit of the embodiment.
Figure 18B:
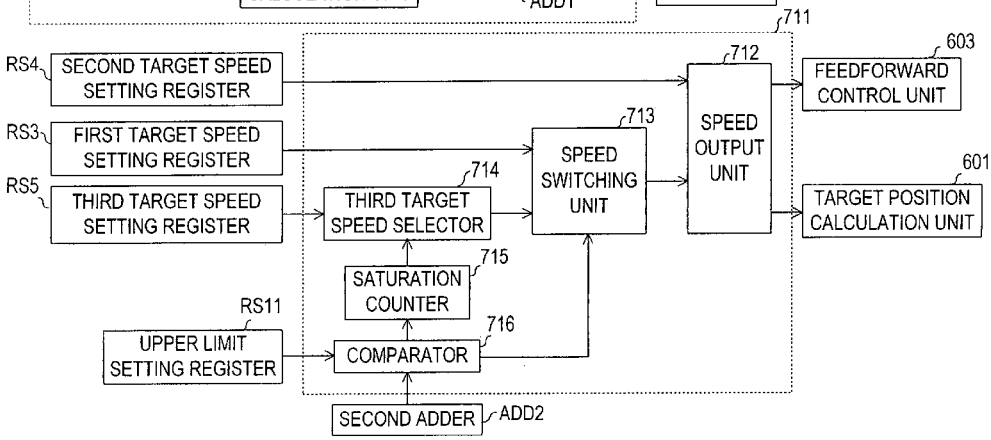

Moreover, the ASIC 70 is provided with a control unit 71 having a feedback calculation process unit 71*a* as shown in FIGS. 18A and 18B, instead of the control unit 60 with the feedback calculation process unit 60*a*. FIG. 18A shows a block diagram illustrating the structure of the feedback calculation process unit 71*a* of the ASIC 70 in the present embodiment. FIG. 18B shows a block diagram illustrating the structure of a target conveyance speed setting unit 711 constituting the feedback calculation process unit 71*a*.

As shown in FIG. 18A, the feedback calculation process unit 71*a* of the present embodiment is provided with the target conveyance speed setting unit 711 having a structure shown in FIG. 18B in place of the target conveyance speed setting unit 607 in the feedback calculation process unit 60*a*.

This target conveyance speed setting unit 711 comprises a speed output unit 712, a speed switching unit 713, a third target speed selector 714, a saturation counter 715, and a comparator 716.

The speed output unit 712 outputs a value of speed outputted from the speed switching unit 713 as the target conveyance speed v (t) during the period between conveyance initiation and time T1 that is when predetermined switching time comes, and outputs the second target conveyance speed v2 stored in the second target speed setting register RS4 as the target conveyance speed v (t) during the period after time T1 passes until the conveyance termination timing T2 comes. The switching timing comes when the count value y in the position counter 57 becomes equal to or more than a predetermined value. The target conveyance speed v (t), outputted from the speed output unit 712, is inputted into the target position calculation unit 601 and the feedforward control unit 603 constituted as described above.

The speed switching unit 713 is constituted to provide either of the speed values between the first target conveyance speed v1 stored in the first target speed setting register RS3 and the speed value outputted from the third target speed selector 714 for the speed output unit 712. Specifically, when a command to select the first target conveyance speed v1 is inputted from the comparator 716, the speed switching unit 713 provides the first target conveyance speed v1 for the speed output unit 712. When a command to select the third target conveyance speed is inputted from the comparator 716, the speed switching unit 713 provides the speed value outputted from the third target speed selector 714 for the speed output unit 712.

The comparator 716 compares the upper limit maintained in the upper limit setting register RS11 and the operation amount u outputted from the second adder ADD2 every time a calculation timing comes. When the operation amount u is less than the upper limit, the comparator 716 provides a command to select the first target conveyance speed v1 for the speed switching unit 713. When the operation amount u is equal to or more than the upper limit, the comparator 716 provides a command to select the third target conveyance speed for the speed switching unit 713. At the time to initiate conveyance control, the comparator 716 inputs a command to select the first target conveyance speed v1.

When the operation amount u is equal to or more than the upper limit, the comparator 716 increments (counts up) a count value CN by one in the saturation counter 715 at every calculation timing. When the operation amount u is less than the upper limit, the comparator 716 clears the counter value of the saturation counter 715 and sets the count value CN to "0". In other words, in the saturation counter 715, the number of determination, which is made when the comparator 716 determines the operation amount u is equal to or more than the upper limit, is stored.

The third target speed selector 714 selects one of the values amongst v31, v32, and v33, stored in the third target speed setting register RS5 corresponding to the count value CN in the saturation counter 715, and provides the selected value for the speed switching unit 713.

Specifically, when the count value CN satisfies the relational expression 0≦CN<m (m: natural number), the third target speed selector 714 provides the speed value v31 for the speed switching unit 713. When the count value CN satisfies the relational expression m≦CN<n (n: natural number that satisfies n>m), the third target speed selector 714 provides the speed value v32 for the speed switching unit 713. When the count value CN satisfies the relational expression n≦CN, the third target speed selector 714 provides the speed value v33 for the speed switching unit 713. As described above, since the values v31, v32, and v33, satisfy the relational expression v31>v32>v33, a lower speed value is selected and inputted into the speed switching unit 713 as the count value CN becomes larger (i.e. as the period wherein the operation amount u is equal to or more than the upper limit becomes longer).

Figure 19:
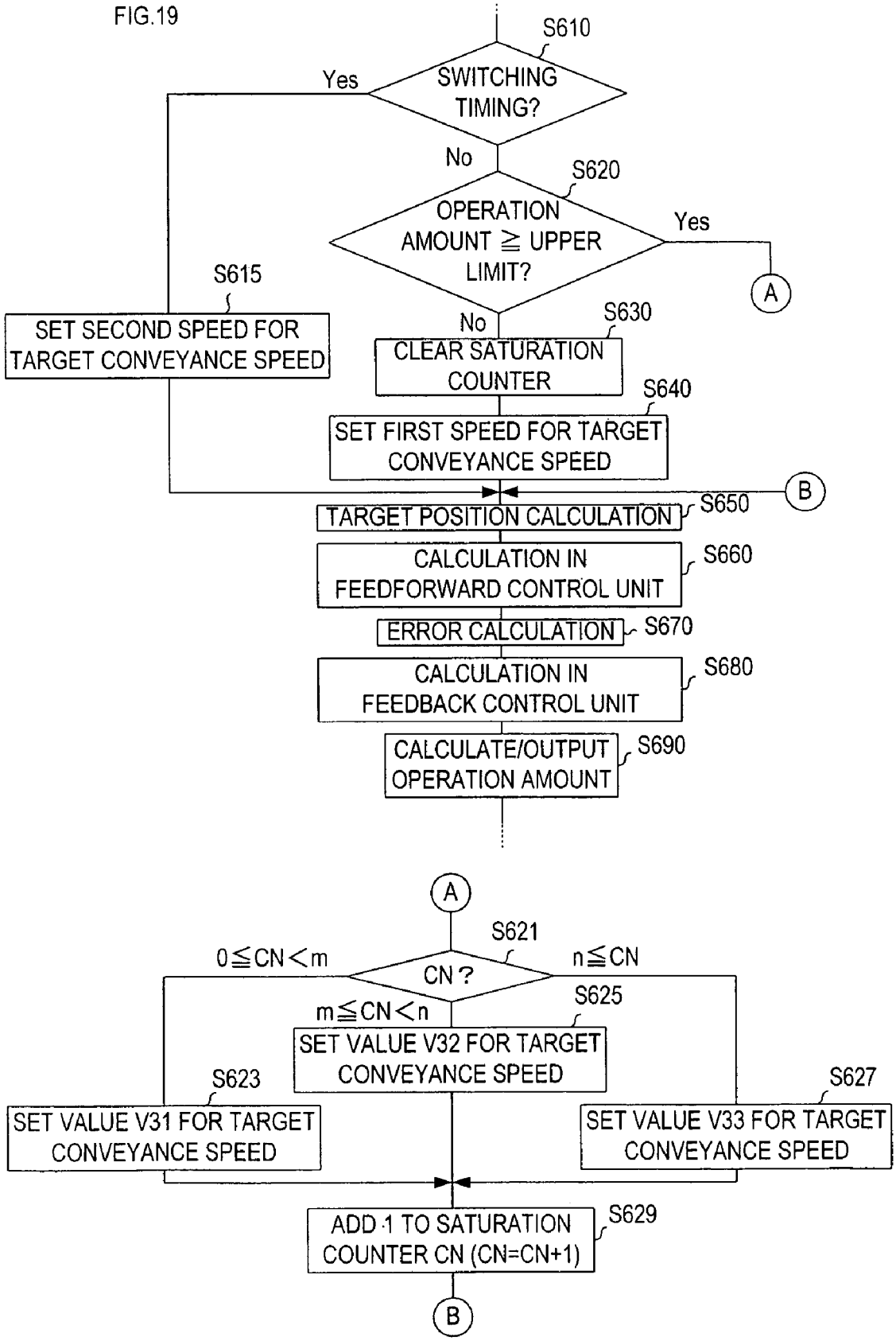
FIG. 19 is a flowchart to show an operation amount calculation process conducted by a control unit of the embodiment.
Figure 20A:
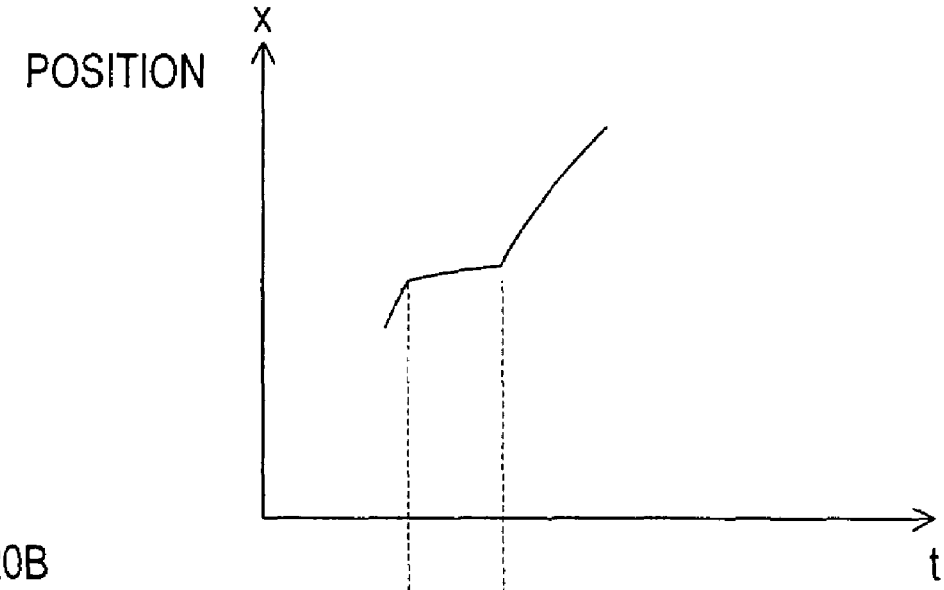
FIGS. 20A and 20B are graphs to show the variation with time of the target position (20A) and the variation with time of the current value (20B) for a case in which control is conducted by the ASIC of the embodiment when the operation amount exceeds the upper limit.
Figure 20B:
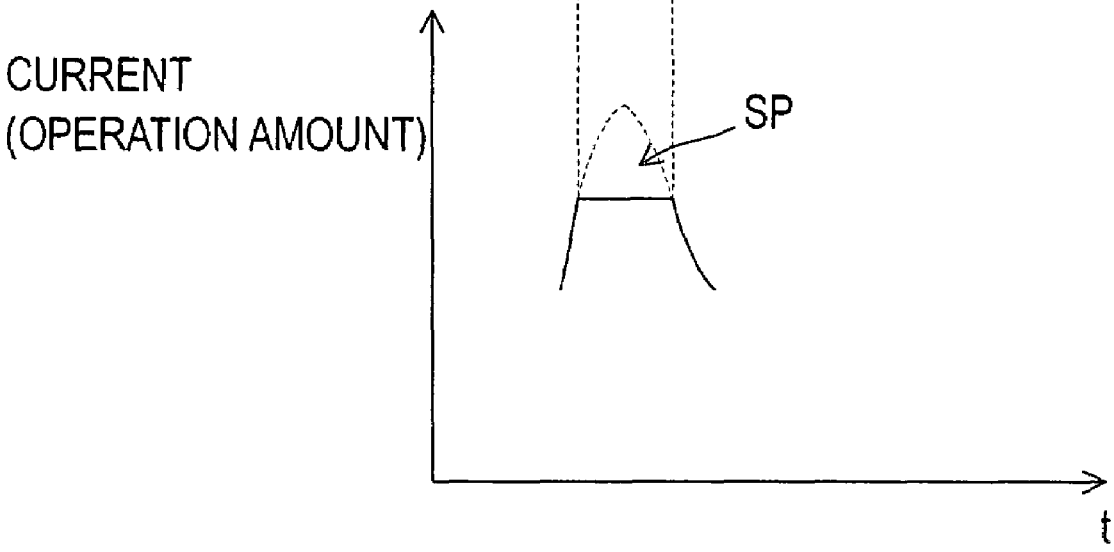
Figure 21A:
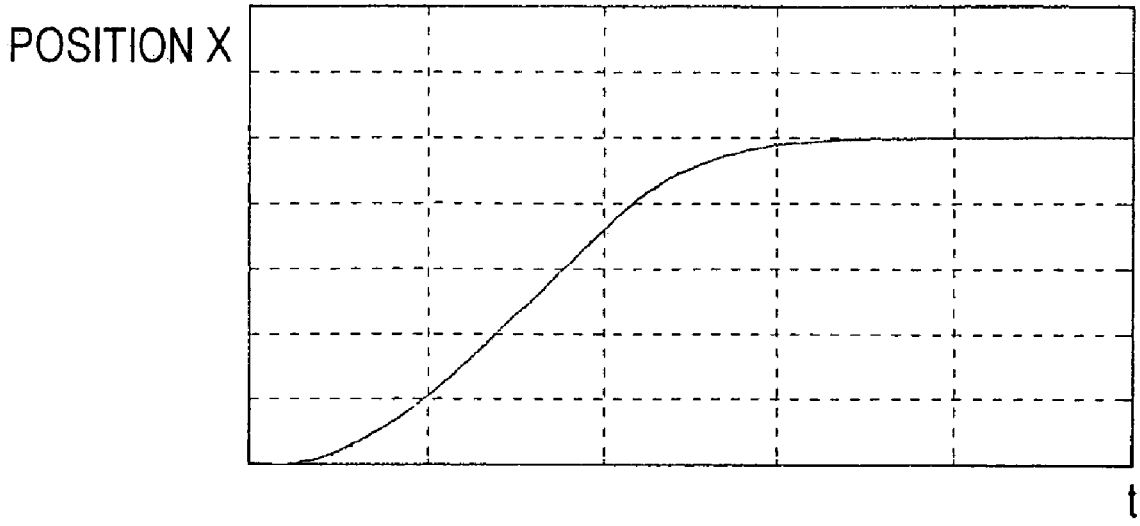
FIGS. 21A and 21B are graphs to show the variation with time of the target position (21A) and the variation with time of the current value (21B) for a case in which control is conducted by the ASIC of the embodiment when the operation amount exceeds the upper limit.
Figure 21B:
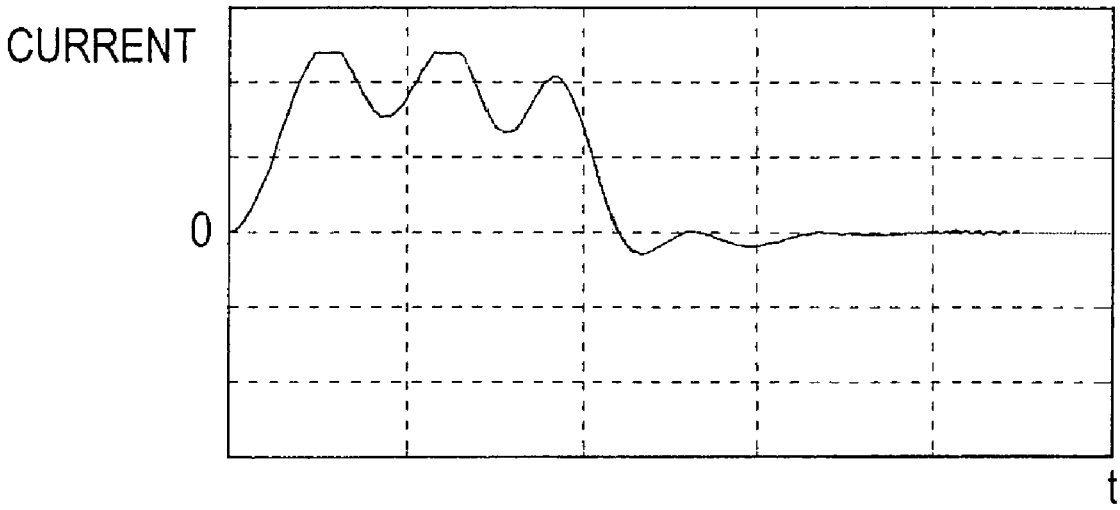

FIG. 19 shows a flowchart describing an operation amount calculation process conducted by the control unit 71 at every calculation timing. This process is conducted in S510 shown in FIG. 16.

In the feedback calculation unit 71*a,* the following process takes place. When a calculation timing comes, if a switching timing for switching into the second target conveyance speed v2 has already come (S610:YES), the process proceeds to S615 and the second target conveyance speed v2 stored in the second target speed setting register RS4 is outputted from the speed output unit 712 as the target conveyance speed v (t).

On the other hand, if the switching timing for switching into the second target conveyance speed v2 has not yet come (S610:NO), the process proceeds to S620, and the comparator 716 determines whether or not the operation amount u is equal to or more than the upper limit. If the operation amount u is less than the upper limit (S620:NO), in S630 the count value in the saturation counter 715 is cleared. In this case, the process proceeds to S640 and a command to select the first target conveyance speed v1, is inputted into the speed switching unit 713 from the comparator 716. Thus, the first target conveyance speed v1 stored in the first target speed setting register RS3, is outputted from the speed output unit 712 as the target conveyance speed v (t).

Alternatively, if the operation amount u is equal to or more than the upper limit (S620:YES), in S621 the third target speed selector 714 refers to the count value CN in the saturation counter 715. Subsequently, a speed value corresponding to the count value CN is outputted from the speed switching unit 713 and one of the third target conveyance speed corresponding to the count value CN is outputted as the target conveyance speed v (t) from the speed output unit 712 (in one of S623, S625 or S627). Specifically, when the count value CN satisfies the relational expression 0≦CN<m, the process proceeds to S623, and the speed value V31 is outputted as the target conveyance speed v (t) from the speed output unit 712.

When the count value CN satisfies the relational expression m≦CN<n, the process proceeds to S625, and the speed value v32 is outputted as the target conveyance speed v (t) from the speed output unit 712. When the count value CN satisfies the relational expression n≦CN, the process proceeds to S627, and the speed value v33 is outputted as the target conveyance speed v (t) from the speed output unit 712. In case one of the third target conveyance speeds is set as the target conveyance speed v (t), in S629 "1" is added to the count value CN in the saturation counter 715.

In S650 of the operation amount calculation process, in the target position calculation unit 601 that receives the target conveyance speed v (t) outputted from the target conveyance speed setting unit 711, a value which is larger than a previous value and corresponds to the outputted target conveyance speed v (t) is calculated as a value for the target position x (t). That is, when the third target conveyance speed is inputted as the target conveyance speed v (t), the target position x (t) is located more toward the upstream in the conveyance direction as compared to a target position located in a case in which the first target conveyance speed v1 is inputted.

Subsequently, in S660, the operation amount u1 (t), corresponding to the above-described target conveyance speed v (t), is calculated in the feedforward control unit 603. In a case in which the third target conveyance speed is inputted as the target conveyance speed v (t), a smaller operation amount u1 (t) is calculated as the target conveyance speed v (t) as compared to a case wherein the first target conveyance speed v1 is inputted.

In S670, the error Θ is calculated in the first adder ADD1 based on the target position x (t) calculated by the target position calculation unit 601 in S650 and the count value y in the position counter 57. In S680, the operation amount u2 (t) is calculated by the feedback control unit 605 based on the error Θ. When the third target conveyance speed is inputted as the target conveyance speed v (t), a smaller operation amount u2 (t) is calculated as compared to a case wherein the first target conveyance speed v1 is inputted as the target conveyance speed v (t).

In S690, the operation amount u (t) is calculated in the second adder ADD2 based on the operation amount u1 (t) obtained in S660 and the operation amount u2 obtained in S680 and inputted into the drive signal generator 55. FIGS. 20A, 20B, 21A, and 21B, show graphs indicating the variation with time of the target position x when the operation amount u exceeds the upper limit and control is conducted with ASIC 70 (FIGS. 20A and 21A), and indicating the variation with time of the current value attained in the driving circuit 47 (FIGS. 20B and 21B) in this condition.

In the ASIC 70, if the operation amount u exceeds the upper limit, the target position x (t) is set at a position more toward the upstream in the conveyance direction than usual by temporarily decreasing the target conveyance speed v (t) (i.e. the target traveling amount is set smaller than usual). Therefore, as well as in the ASIC 53, it is possible to shorten the period SP wherein the operation amount u exceeds the upper limit. Consequently, with MFD 1 in which the method of this embodiment is used, it is also possible to appropriately convey the paper P with a large load, and to accurately convey the paper P so as to move the reference point to the image formation point GP. As a result of accurate conveyance of paper P, it is possible to form an image on one surface of paper P without displacement, and to inhibit lines of gaps that may otherwise be created from a failure in image formation.

The above has described an example to resolve the status wherein the operation amount u exceeds the upper limit by decreasing target conveyance speed. It is also possible to resolve the status wherein the operation amount u exceeds the upper limit for a long period of time by switching the value of the parameter α, which constitutes an arithmetic expression for extracting the target position x (t) from the target conveyance speed v (t).

Third Embodiment

Figure 22:
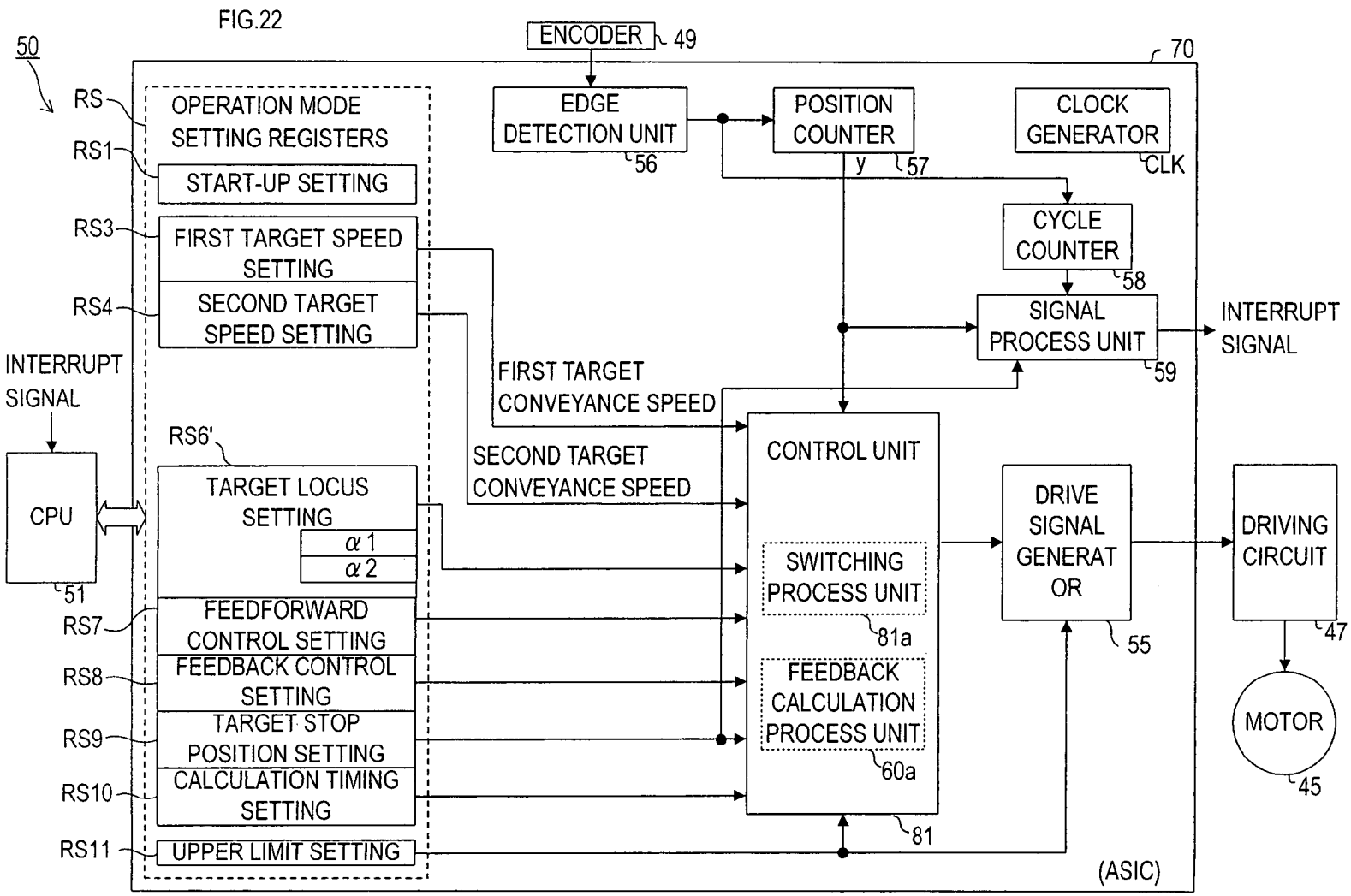
FIG. 22 is a block diagram to show the structure of ASIC of still another embodiment.

FIG. 22 shows a block diagram illustrating the structure of ASIC 80 of the third embodiment. The ASIC 80 has a structure only partly different from the structure of the ASIC 53. The same reference numerals are given to the same constituents of the ASIC 80 as the constituents of the ASIC 53, and the description thereof is not repeated.

Figure 23:
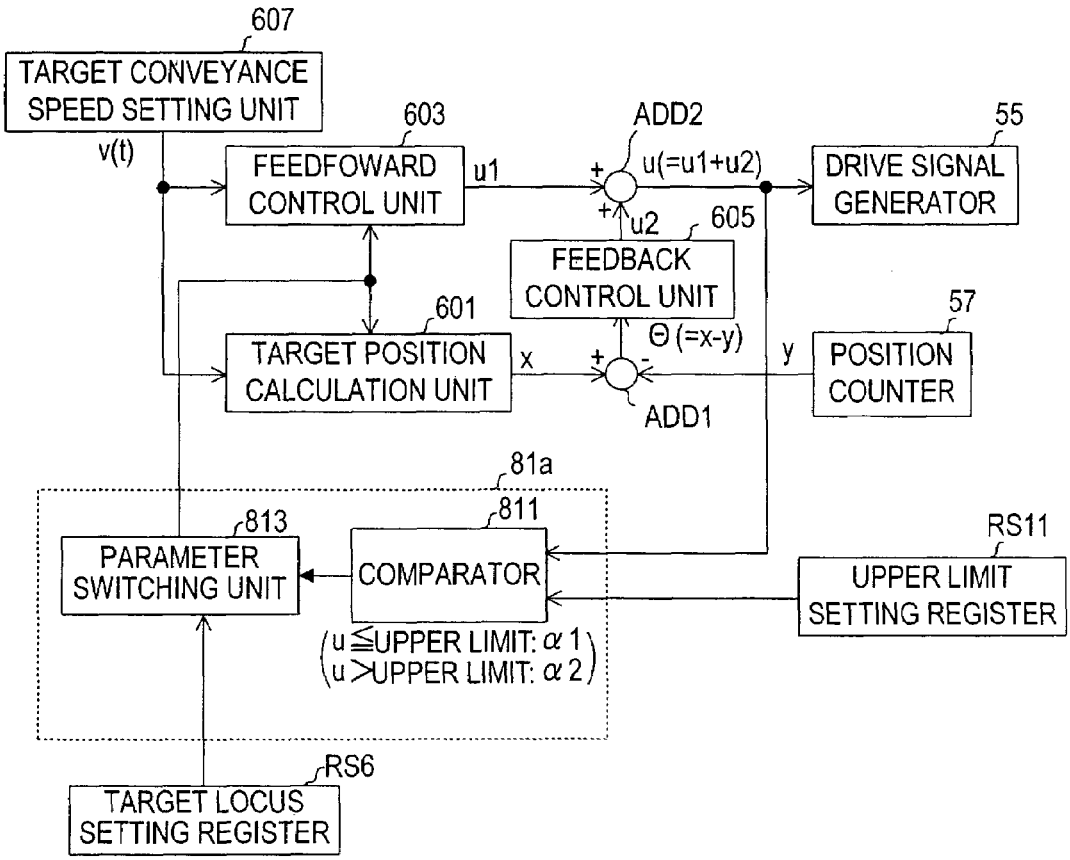
FIG. 23 is a block diagram to show the structure of a switching process unit of the embodiment.

As shown in FIG. 22, the ASIC 80 is provided with a target locus setting register RS6' that maintains plurality of values $\alpha 1$ and $\alpha 2$ for the above-described parameter $\alpha$ to replace the target locus setting register RS6 shown in FIG. 4. Moreover, the ASIC 80 is provided with a control unit 81 having a switching process unit 81*a* and a feedback calculation process unit 60*a* constituted as shown in FIG. 23 in place of the control unit 60 with the switching process unit 61 and the feedback calculation process unit 60*a* constituted as shown in FIG. 11. FIG. 23 shows a block diagram illustrating the structure of the switching process unit 81*a* of the ASIC 80.

As shown in FIG. 23, the switching process unit 81*a* comprises a comparator 811 and a parameter switching unit 813. The comparator 811 compares the upper limit maintained in the upper limit setting register RS11 and the operation amount u outputted from the second adder ADD 2 every time a calculation timing comes. When the operation amount u is less than the upper limit, the comparator 811 provides a command for the parameter switching unit 813 to select a first value. When the operation amount u is equal to or more than the upper limit, the comparator 811 provides a command for the parameter switching unit 813 to select a second value.

When a command to select the first value is inputted from the comparator 811, the parameter switching unit 813 sets the value $\alpha 1$ stored in the target locus setting register RS6' into the target position calculation unit 601 and the feedforward control unit 603. When a command to select the second value is inputted from the comparator 811, the parameter switching unit 813 sets the value $\alpha 2$ stored in the target locus setting register RS6' into the target position calculation unit 601 and the feedforward control unit 603.

The values $\alpha 1$ and $\alpha 2$, registered in the target locus setting register RS6', are values that satisfy a relational expression $\delta 1 > \delta 2$ wherein $\delta 1$ represents the inclination of the target position x (t) when the value $\alpha 1$ is set as the parameter $\alpha$ for the arithmetic expression for extracting the target position x (t) from the target conveyance speed v (t), (i.e. $\delta 1 = dx(t,\alpha 1)/dt$), and $\delta 2$ represents the inclination of the target position x (t) when the value $\alpha 2$ is set as the parameter $\alpha$ (i.e. $\delta 2 = dx(t,\alpha 2)/dt$).

Figure 24:
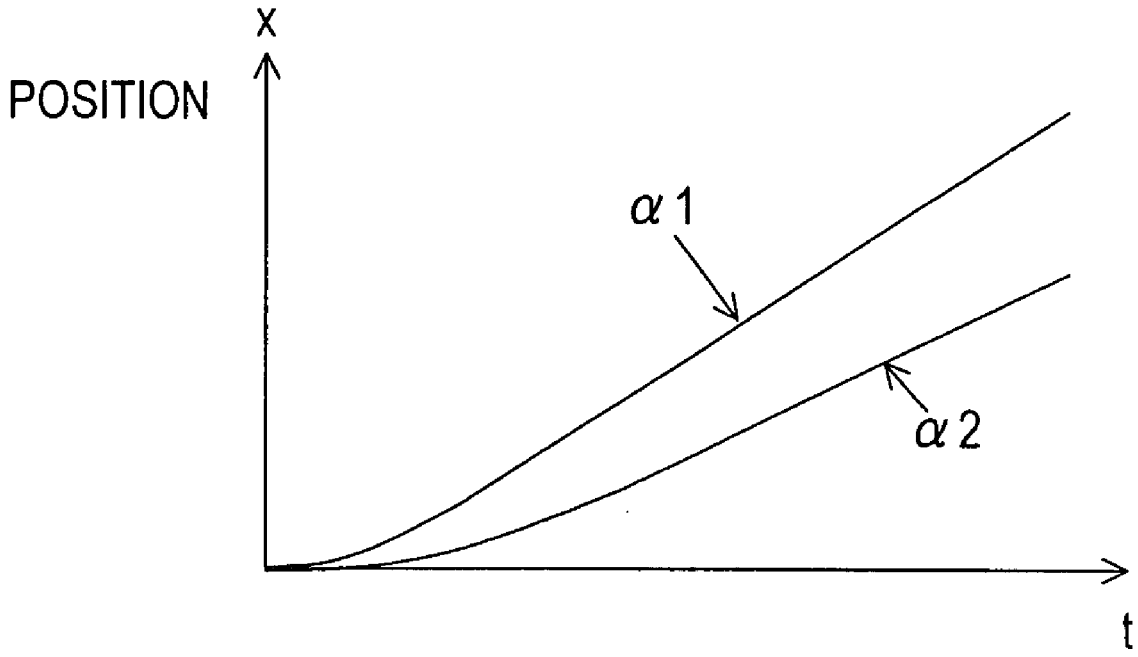
FIG. 24 is a graph to show the locus of the target position for cases in which the parameter $\alpha=\alpha 1$, and $\alpha=\alpha 2$.

FIG. 24 shows a graph indicating the locus of the target positions x (t) outputted from the target position calculation unit 601 when $\alpha = \alpha 1$, and the locus of the target positions x (t) outputted from the target position calculation unit 601 when $\alpha = \alpha 2$. However, this graph shows the locus in the case in which $\alpha = \alpha 1$ or $\alpha = \alpha 2$ is set at time t=0.

The target position calculation unit 601 and the feedforward control unit 603 are constituted to obtain variation by a predetermined calculation with the target conveyance speed v (t) and the parameter $\alpha$, to add the variation to a previous calculation result (i.e. to conduct integration), and to obtain the target position x (t) and the operation amount u1 (t) corresponding to the target conveyance speed v (t). Thus, when the value of the parameter $\alpha$ is changed from $\alpha 1$ to $\alpha 2$ during conveyance control, the target position x (t) is set more toward the upstream in the conveyance direction as compared to a case wherein the parameter $\alpha = \alpha 1$.

Figure 25:
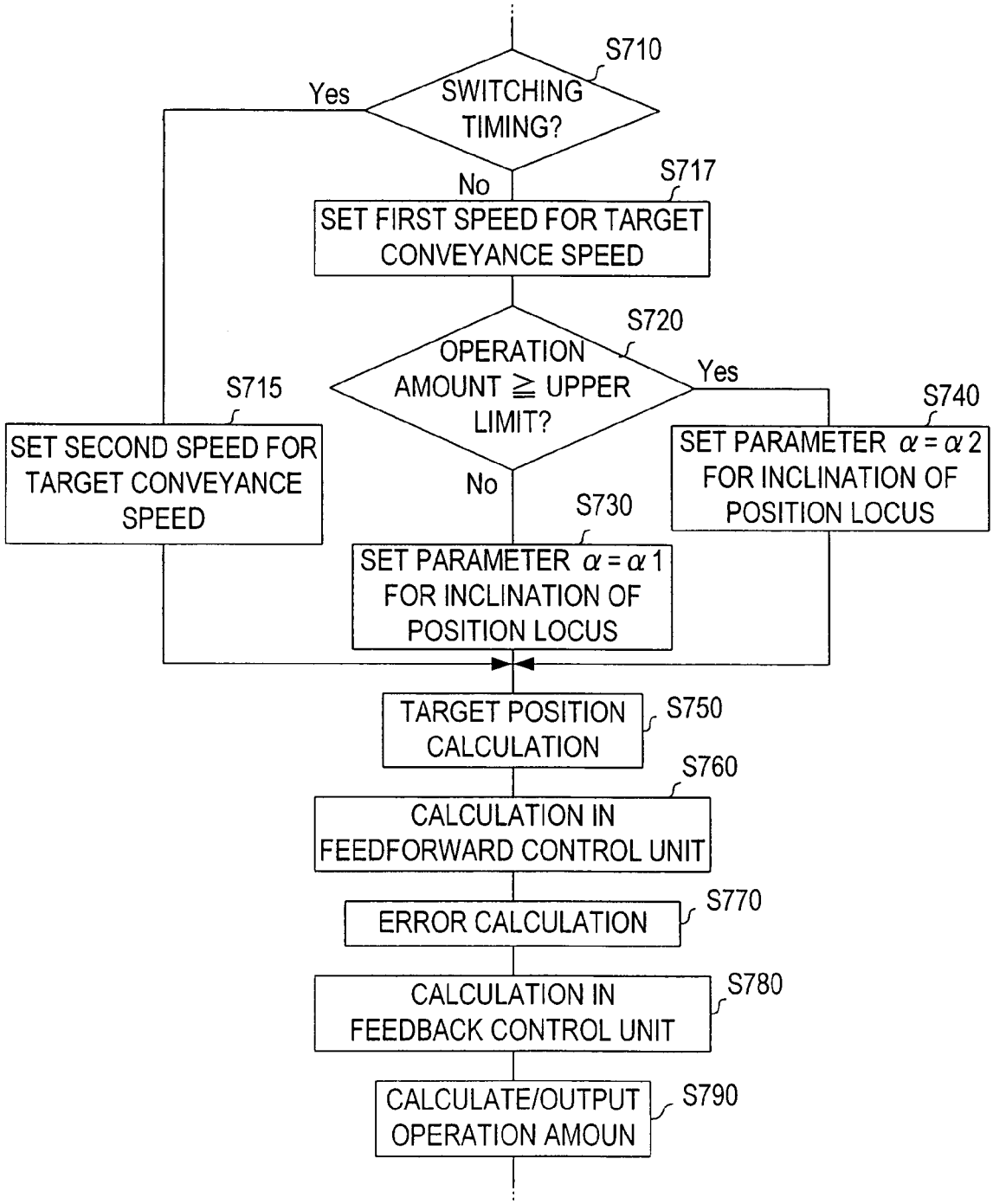
FIG. 25 is a flowchart to show an operation amount calculation process conducted by a control unit of the embodiment.

FIG. 25 shows a flowchart describing an operation amount calculation process conducted by the control unit 81 at every calculation timing. This process is conducted in S510 shown in FIG. 16.

When a calculation timing comes, in S710 it is determined whether or not switching timing into the second target conveyance speed v2 has come. When it is determined that the switching timing has come (S710:YES), the process proceeds to S715 and the second target conveyance speed v2 stored in the second target speed setting register RS4 is outputted as the target conveyance speed v (t) from the target conveyance speed setting unit 607.

On the other hand, when it is determined that the switching timing has not yet come (S710:NO), the process proceeds to S717 and the first target conveyance speed v1 stored in the first target speed setting register RS3 is outputted as the target conveyance speed v (t) from the target conveyance speed setting unit 607.

Subsequent to the process in S717, for the process in S720 the comparator 811 determines whether or not the operation amount u is equal to or more than the upper limit. When the operation amount u is less than the upper limit (S720:NO), the process proceeds to S730. In S730, the comparator 811 provides a command for the parameter switching unit 813 to select the first value, and the parameter $\alpha = \alpha 1$ is set in the target position calculation unit 601 and the feedforward control unit 603. When the operation amount u is equal to or more than the upper limit (S720:YES), the process proceeds to S740 wherein the comparator 811 provides a command for the parameter switching unit 813 to select the second value, and the parameter $\alpha = \alpha 2$ is set in the target position calculation unit 601 and the feedforward control unit 603.

In S750, a calculation is conducted in the target position calculation unit 601, which receives the target conveyance speed v (t) outputted from the target conveyance speed setting unit 711, in order to obtain the target position x (t) corresponding to the target conveyance speed v (t). When the operation amount u is less than the upper limit, the parameter $\alpha = \alpha 1$ is used in the calculation. When the operation amount is equal to or more than the upper limit, the parameter $\alpha = \alpha 2$ is used. In a case where the parameter $\alpha = \alpha 2$, the target position x (t) is calculated to be located more toward the upstream in the conveyance direction as compared to a case wherein the target position x (t) is calculated with the parameter $\alpha = \alpha 1$.

In S760, the above-described target conveyance speed v (t) and the operation amount u1 (t) corresponding to the value of the parameter $\alpha$ are calculated in the feedforward control unit 603. In S770, the error $\Theta$ is calculated in the first adder ADD1 based on the target position calculated by the target position calculation unit 601 in S750 and the count value y in the position counter 57. In S780, the operation amount u2 (t) is calculated by the feedback control unit 605 based on the calculation result in S770. In a case in which the parameter $\alpha = \alpha 2$, a smaller value is obtained for the operation amount u2 (t) as compare to a case wherein the parameter $\alpha = \alpha 1$.

In S790, the operation amount u (t) is calculated in the second adder ADD2 based on the operation amount u1 (t) obtained in S760 and the operation amount u2 (t) calculated in S780, and is inputted into the drive signal generator 65. Consequently, in a case in which the parameter $\alpha = \alpha 2$, a smaller value is obtained for the operation amount u (t) as compared to a case wherein the parameter $\alpha = \alpha 1$.

As described above, when the operation amount u is equal to or more than the upper limit, in the ASIC 80 the target position x (t) is set at a position more toward the upstream in the conveyance direction than usual by switching the parameter $\alpha$ that relates to the inclination of the target position x (t) (i.e. the target travel distance is set to be smaller than usual). Hence, according to the third embodiment, it is possible to shorten the period SP wherein the operation amount u exceeds the upper limit as well as in other embodiments described above.

Therefore, in the MFD 1 wherein the method of the present embodiment is used, it is also possible to appropriately convey paper P with a large load and to accurately convey the paper P so as to move a reference point to the image formation point GP. As a result of the accurate conveyance of paper P, it is also possible to form an image on one surface of paper P without displacement and to inhibit lines of gaps, which may be created from a failure in image formation.

The control device, the conveyance control device, the conveyance system and the image forming system of the present invention are not limited to the above-described embodiments. Variations and modifications are possible within the scope of the present invention.

For example, if the status wherein the operation amount u exceeds the upper limit is not so promptly resolved even when the device is constituted to resolve this status, it is possible to reconstitute the device to change the value of the parameter $\alpha$ so that the inclination of the target position x (t) becomes furthermore smaller by switching the parameter $\alpha$.

Figure 26A:
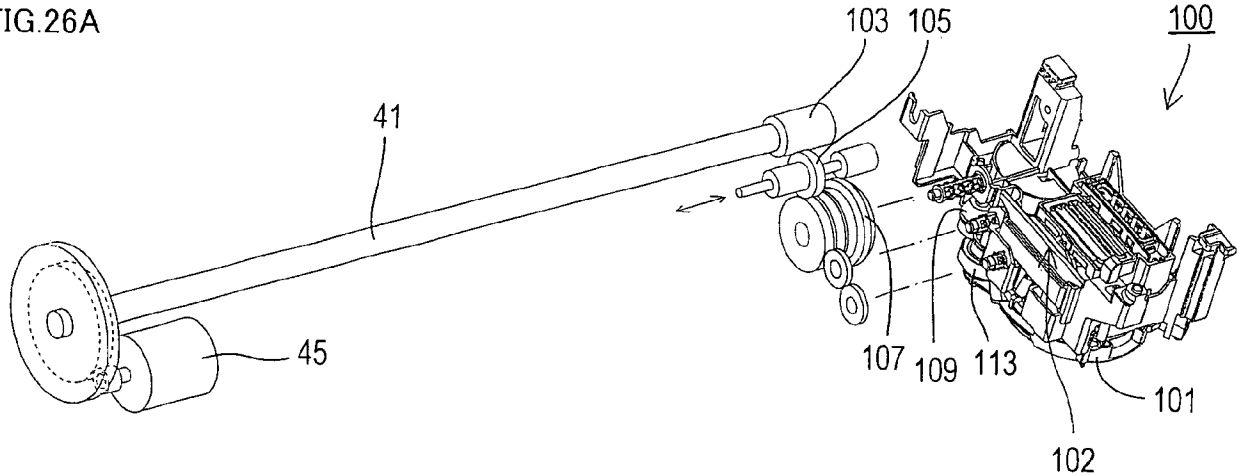
FIG. 26A is an explanatory view to show the structure of a driving system for a cam of still another embodiment.
Figure 26B:
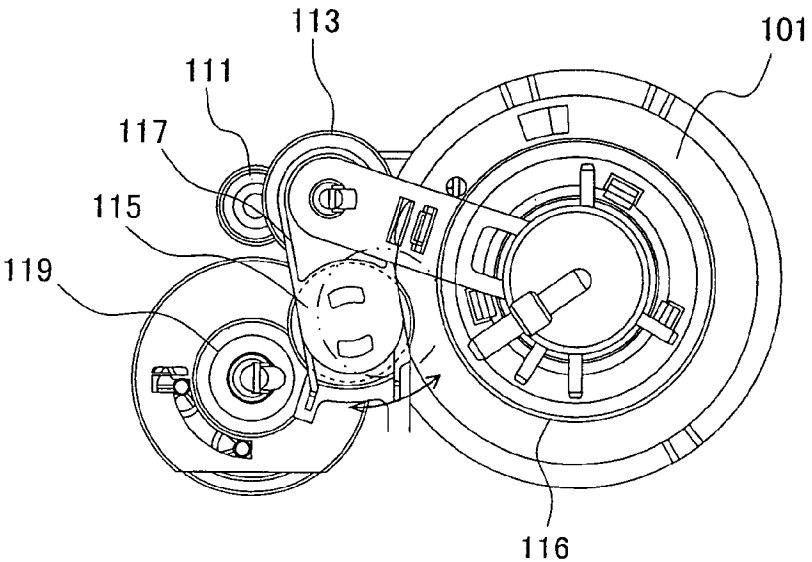
FIG. 26B is an explanatory view to show the structure in the vicinity of the cam.

The present invention can be also applied to a driving system 100 for a cam 101 that rotates together with the conveyance roller 41, FIG. 26A shows the structure of the driving system 100 for the cam 101 that moves a wiper 102, which wipes the nozzle surface of the recording head 15, from a retreated position incapable of contacting with the recording head 15 therein, to a wipe position wherein the wiper 102 comes in contact with the recording head 15 so as to conduct a wipe operation. FIG. 26B shows the structure around the cam 101.

In the driving system 100 of the cam 101 shown in FIGS. 26A and 26B, when the carriage 17 moves to a predetermined maintenance position, a slide gear 105 engages with a large-diameter bevel gear 107, and the conveyance roller 41 connected to the motor 45 is engaged with the cam 101 via a drive gear 103, the slide gear 105, the large-diameter bevel gear 107, a small-diameter bevel gear 109, a deceleration gear 111, a sun gear 113, and a planet gear 115. The large-diameter bevel gear 107 is engaged with the small-diameter gear 109. At this engagement of these bevel gears, rotational movement is converted from a rotational movement pivoting around an axis in a horizontal direction, into rotational movement pivoting around an axis in a vertical direction. The rotational force is transmitted from the conveyance roller 41 having a rotational axis in the horizontal direction to the cam 101 having a rotational axis in the vertical direction.

Specifically, the small-diameter bevel gear 109 is engaged with the deceleration gear 111, and the deceleration gear 111 is engaged with the sun gear 113. The sun gear 113 is engaged with the planet gear 115 provided on an end portion of a swing arm 177 that is rotatable about the sun gear 113. When the sun gear 113 rotates in the counterclockwise direction in FIG. 26B, the planet gear 115 rotates about the sun gear 113 in the counterclockwise direction and engages with the driven gear 116. The cam 101, in this state, is driven so as to be rotated in the counterclockwise direction. On the other hand, when the sun gear 113 rotates in the clockwise direction, the planet gear 115 is rotated about the sun gear 113 in the clockwise direction and is engaged with the gear 119. In this state, the driving force is applied to the cam 101. Therefore, the cam 101 is driven and rotated in the counterclockwise direction, but not in the clockwise direction.

In a case in which a cam 101 is constituted as above, the cam 101 cannot be reversely rotated unless the cam 101 stops at a target rotational angle. Thus, rotational control on the cam 101 needs to be conducted several times so as to rotate the cam 101 more than one time and to stop the cam 101 at the target rotational angle. However, since the same control is conducted as the above-described conveyance control, it is possible to stop the cam 101 accurately and promptly at a target rotational angle. The rotational amount of the cam 101 can be detected with the encoder 49 provided on the conveyance roller 41.

In a conventional conveyance device wherein an object is conveyed by driving force being applied thereto, an object is still moved slightly toward the downstream side of a conveyance path by inertia even when the driving of the conveyance rollers is stopped. For this reason, in this type of conveyance device, the movement of an object to be conveyed toward the downstream of a conveyance path by inertia even after the driving of the conveyance rollers is stopped is already expected. Therefore, the conveyance device is controlled in a manner so that an object stops at a target point (conveyance destination).

In a conventional conveyance device, due to a large load on an object generated by the influence from the material of an object and the interference between an object and conveyance path, a target set by the conveyance control device may be largely different from the actual conveyance distance. In this case, conveyance with the maximum capacity of the conveyance device is continued up to the vicinity of the conveyance destination. If conveyance with the maximum capacity of the conveyance device is continued, a more than necessary driving force is applied to an object when the load on the object is reduced, and a feedback control may not be able to function appropriately.

In this kind of situation, even when the driving of the conveyance rollers is stopped, the distance the object is moved by inertia is large and the object may be moved more than expected. In other words, in a conventional conveyance control device, an object cannot be accurately conveyed to a conveyance destination when a large load is applied to the object.

According to the embodiments described above, the following effects can be attained. One of the effects is that a skill is provided wherein a driving object can be moved for a predetermined distance with high accuracy irrespective of a large load generated on the driving object. Another effect is that a skill is provided wherein an object can be accurately provided to a conveyance destination irrespective of a large load generated on the object. Still another effect is that an image forming system can be provided wherein an image can be formed at a predetermined position of an image forming medium.

A control device according to the above-described embodiment, the above and other issues can be solved.

What is claimed is:

1. A control device connected to a driving device that is operated according to a control signal inputted therein and applies a driving force corresponding to an operation amount thereof to a driving object, the control device causing the driving object to be moved a predetermined distance by controlling the driving device, the control device comprising:

a detector that detects a travel distance of the driving object;

a target setter that sets a target amount of the driving object in every predetermined period when the driving object is moved;

an operation amount calculator that calculates, in every predetermined period, the operation amount from at least a detection result of the detector and the target amount set by the target setter;

a controller that causes the driving device to move the driving object for a predetermined distance by sequentially providing control signals corresponding to the operation amount calculated by the operation amount calculator; and an operation amount determiner that determines, in every predetermined period, whether the operation amount calculated by the operation amount calculator is equal to or more than a predetermined upper limit;

wherein the target setter sets the target amount according to a first rule when the operation amount which is calculated from at least the detection result of the detector and the target amount previously set by the target setter is determined by the operation amount determiner to be less than the upper limit, and the target setter sets the target amount according to a second rule when the operation amount which is calculated from at least the detection result of the detector and the target amount previously set by the target setter is determined by the operation amount determiner to be equal to or more than the upper limit.

2. The control device as set forth in claim 1, wherein the target amount according to the second rule is smaller than the target amount according to the first rule.

3. The control device as set forth in claim 1, wherein the target setter sets a target amount equal to a previous target amount according to the second rule.

4. The control device as set forth in claim 1, wherein the target setter is constituted to set the target amount sequentially larger with a first variation according to the first rule and with a second variation according to the second rule.

5. The control device as set forth in claim 4, wherein the second variation is smaller than the first variation.

6. The control device as set forth in claim 1 further comprising a target speed setter that is constituted to sequentially set a target speed for the target setter, wherein the target setter is constituted to sequentially set the target amount with a variation corresponding to a target speed set by the target speed setter, the target speed setter setting a first value as the target speed when the operation amount is determined by the operation amount determiner to be less than the upper limit, and the target speed setter setting a second value that is less than the first value as the target speed when the operation amount is determined to be equal to or more than the upper limit.

7. The control device as set forth in claim 6 further comprising a duration determiner that determines a period wherein the operation amount is continuously equal to or more than the upper limit based on a determination result of the operation amount determiner, wherein the target speed setter sets the target speed lower as the period determined by the duration determiner becomes longer when the operation amount is determined by the operation amount determiner to be equal to or more than the upper limit.

8. The control device as set forth in claim 1, wherein the target setter sets a position equal to a previous target travel position when the operation amount is determined by the operation amount determiner to be equal to or more than the upper limit.

9. The control device as set forth in claim 1, wherein the target setter is constituted to set a target travel position at a position sequentially toward the downstream from the initial position with a predetermined interval, and sets a first amount for the predetermined interval when the operation amount is determined by the operation amount determiner to be less than the upper limit, and sets a second target amount smaller than the first target amount for the interval when the operation amount is determined to be equal to or more than the upper limit.

* * * * *

UNITED STATES PATENT AND TRADEMARK OFFICE

CERTIFICATE OF CORRECTION

PATENT NO. : 7,607,661 B2
APPLICATION NO. : 11/188727
DATED : October 27, 2009
INVENTOR(S) : Akiyama et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 356 days.

Signed and Sealed this

Twelfth Day of October, 2010

David J. Kappos

David J. Kappos
*Director of the United States Patent and Trademark Office*